US006342343B1

(12) United States Patent
Toya

(10) Patent No.: US 6,342,343 B1
(45) Date of Patent: Jan. 29, 2002

(54) PHOTOTHERMOGRAPHIC MATERIAL

(75) Inventor: Ichizo Toya, Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/570,552

(22) Filed: May 12, 2000

(30) Foreign Application Priority Data

May 18, 1999 (JP) ..... 11-136770

(51) Int. Cl.[7] ..... G03C 1/498
(52) U.S. Cl. ..... 430/619; 430/513; 430/530
(58) Field of Search ..... 430/519, 510, 430/527, 513, 617, 530

(56) References Cited

U.S. PATENT DOCUMENTS 5,266,452 A * 11/1993 Kitchin et al. ..... 430/510
5,547,821 A * 8/1996 Melpolder et al. ..... 430/619

* cited by examiner

*Primary Examiner*—Thorl Chea
(74) *Attorney, Agent, or Firm*—Birch, Stewart, Kolasch & Birch, LLP

(57) ABSTRACT

A photothermographic material comprising on one surface side of the support at least one kind of photosensitive silver halide, a photo-insensitive organic silver salt, a reducing agent for a silver ion, and a binder, and having an electro-conductive layer, wherein the surface resistivity (under the atmosphere of 25° C., 25% RH) is $10^{11}\Omega$ or less, and the optical density at the exposure wavelength of the surface side containing the photosensitive silver halide is from 0.2 to 3.0.

6 Claims, No Drawings

PHOTOTHERMOGRAPHIC MATERIAL

FIELD OF THE INVENTION

The present invention relates to a photothermographic material.

BACKGROUND OF THE INVENTION

Reduction of waste solutions has been strongly desired in recent years in the medical field from the viewpoint of environmental protection and space saving. Accordingly, techniques concerning a thermographic photosensitive material for medical diagnosis and photographic technical use in which exposure can be performed efficiently with a laser/image setter or a laser/imager and can form a clear black image exhibiting high resolving power and sharpness have been required. Such a thermographic photosensitive material can offer to customers a simpler and environmentally benign thermographic processing system without the use of solution type processing chemicals.

There also arises the same requirement in the field of general image-forming materials but the medical image is characteristics in that a blue black tone image is preferably used because high image quality which is excellent in sharpness and graininess is necessitate as precise imaging is required, in addition, from the viewpoint of easiness of diagnosis. At present, various hard copy systems utilizing pigments and dyes such as ink jet printers and electrophotography prevail as general image-forming systems, however, none of these systems are satisfactory as a medical image output system.

On the other hand, thermal image-forming methods making use of organic silver salts are described, for example, in U.S. Pat. Nos 3,152,904 and 3,457,075, and B. Shely, *Thermally Processed Silver Systems*, "Imaging Processes and Materials", compiled by J. Sturge, V. Walworth, A. Shepp, 8th Ed., Neblette, Chapter 9, p.279(1989). In particular, a photothermographic material generally has a-photosensitive layer comprising a catalytically active amount of photocatalyst (e.g., a silver halide), a reducing agent, a reducible silver salt (e.g., an organic silver salt), and a toner which controls the tone of silver according to necessity, having dispersed in a binder matrix. A photothermographic material forms a black silver image by heating at high temperature (e.g., 80° C. or more) after image exposure to cause an oxidation reduction reaction between a silver halide or a reducible silver salt (which functions as an oxidizing agent) and a reducing agent. The oxidation reduction reaction is accelerated by the catalytic action of the latent image of the silver halide generated by exposure. Therefore, the black silver image is formed in the exposed area. The above thermal image-forming methods are described in various literature including U.S. Pat. No. 2,910,377 and JP-B-43-4924 (the term "JP-B" as used herein means an "examined Japanese patent publication") These thermal image-forming methods making use of organic silver salts can achieve satisfactory image quality and tone as a medical image.

However, for applying thermal image-forming methods to medical diagnosis, not only various photographic characteristics should be improved but also images should be those not adversely affecting medical diagnosis. Above all, there is an important problem that if dusts and the like adhere to the photographic material during photographing at medical site, the clear spots are generated in the area. There is also the case that dusts adhere to photographic materials during processing steps of cutting and packaging. The adhesion of dusts is liable to increase as the processing rate increases, therefore, economically disadvantageous.

It is important for medical diagnosis to improve such clear spot failure due to the adhesion of dusts while maintaining photographic characteristics, in particular, not causing unevenness of density by processing.

SUMMARY OF THE INVENTION

An object of the present invention is to provide a photothermographic material which is free from clear spot failure and does not cause unevenness of density by processing.

The above object of the present invention has been achieved by the following means.

(1) A photothermographic material comprising on one surface side of the support at least one kind of photosensitive silver halide, a photo-insensitive organic silver salt, a reducing agent for a silver ion, and a binder, and having an electroconductive layer, wherein the surface resistivity (under the atmosphere of 25° C., 25% RH) of the material is $10^{11}\Omega$ or less, and the optical density at the exposure wavelength of the surface side containing the photosensitive silver halide is from 0.2 to 3.0.

(2) The photothermographic material as described in the above item (1), wherein the electroconductive layer contains a metallic oxide.

(3) The photothermographic material as described in the above item (1) or (2), wherein the electroconductive layer is provided on the surface of the support opposite to the side which contains the photosensitive silver halide.

(4) The photothermographic material as described in any of the above items (1), (2) and (3), wherein the optical density at the exposure wavelength of the surface of the support opposite to the side which contains the photosensitive silver halide is from 0.2 to 3.0.

(5) The photothermographic material as described in any of the above items (1) to (4), wherein an antihalation layer which is decolored by the heat at thermal development is provided on the surface of the support opposite to the side which contains the photosensitive silver halide.

(6) The photothermographic material as described in any of the above items (1) to (5), wherein the total film thickness exclusive of the support is 15 to 38 $\mu$m.

DETAILED DESCRIPTION OF THE INVENTION

The present invention will be described in detail below.

The photothermographic material according to the present invention comprises a support having provided thereon an image-forming layer containing a photo-insensitive organic silver salt and a binder, and further contains on the same side of the support a photosensitive silver halide and a reducing agent for a silver ion. The image-forming layer is preferably a photosensitive layer containing a photosensitive silver halide. The photothermographic material further have an electroconductive layer, and the surface resistivity of either surface of the material (under the atmosphere of 25° C., 25% RH) is $10^{11}\Omega$ or less. The optical density (i.e., an absorbance) at the exposure wavelength of the photosensitive layer side (exclusive of the support) is from 0.2 to 3.0, preferably from 0.2 to 2.0, and the optical density at the exposure wavelength of the back surface side (exclusive of the support) is preferably from 0.2 to 3.0, more preferably from 0.2 to 2.0, most preferably from 0.2 to 1.0. These optical densities are the optical densities at exposure time, i.e., before thermal development processing. By providing the above electroconductive layer to restrict the surface resistivity of the photothermographic material within the above range and regulating the optical density at the exposure wavelength of the photosensitive layer side within the above range, a clear spot failure due to adhesion of dusts to the material during producing and processing steps and density unevenness by processing can be prevented, while when the surface resistivity of the material exceeds $10^{11}\Omega$, dusts are liable to be adhered, as a result, a clear spot failure arises. On the other hand, when the optical density of the photosensitive layer side is less than 0.2, density unevenness by processing is generated and when exceeds 3.0, the sensitivity lowers. Concerning the clear spot failure, the total film thickness of the photothermographic material exclusive of the support (the total of both sides) is preferably 15 to 38 μm, particularly preferably from 18 to 35 μm, and when the processing rate is high, the clear spot failure is improved by limiting the total film thickness of the material The optical density of the back surface Within the above range is preferred to ensure sharpness.

The photothermographic material according to the present invention has an electroconductive layer. The electroconductive layer may be a layer containing, e.g., soluble salts (e.g., chloride, nitrate), may be a metal-deposited layer, or a layer containing ionic polymers as disclosed in U.S. Pat. Nos. 2,861,056 and 3,206,312, or insoluble inorganic salts as disclosed in U.S. Pat. No. 3,428,451.

The electroconductive substances which are used in the electroconductive layer of the present invention are electroconductive metallic oxides or electroconductive high molecular compounds.

The electroconductive metallic oxides preferably used in the present invention are crystalline metallic oxide particles, and those containing oxygen defect and a small amount of foreign atoms which take the position of donors to metallic oxides have generally high electroconductivity and are preferred. The latter does not give fog to silver halide emulsions and hence is particularly preferred. Preferred examples of metallic oxides include ZnO, $TiO_2$, $SnO_2$, $Al_2O_3$, $In_2O_3$, $SiO_2$, MgO, BaO, $MoO_3$, $V_2O_5$, etc., and composite oxides of these compounds, and ZnO, $TiO_2$ and $SnO_2$ are particularly preferred. As the examples containing foreign atoms, e.g., the addition of Al, In, etc., to Zno, the addition of Sb, Nb, halogen elements, etc., to $SnO_2$, and Nb, Ta, etc., to $TiO_2$, are effective. The addition amount of these foreign atoms is preferably from 0.01 mol % to 30 mol %, and particularly preferably from 0.1 mol % to 10 mol %.

The metallic oxide particles according to the present invention have electroconductivity, and the volume resistivity is preferably $10^7\Omega\cdot$cm or less, particularly preferably $10^5\Omega\cdot$cm or less (generally $10^1\Omega\cdot$cm or more).

These oxides are disclosed in JP-A-56-143431 (the term "JP-A" as used herein means an "unexamined published Japanese patent application"), JP-A-56-120519 and JP-A-58-62647, etc.

Further, as disclosed in JP-B-59-6235, electroconductive materials comprising the above-described metallic oxides having been adhered to other crystalline metallic oxide particles or fibrous materials (e.g., titanium oxide) may be used.

The average particle size (i.e., the average particle diameter in terms of equivalent sphere diameter) of the electroconductive particles usable in the present invention is preferably 10 μm or less, but electroconductive particles having an average particle size of 2 μm or less are excellent in stability after dispersion and easy to use. When the electroconductive particles having an average particle size of 0.5 μm or less (generally 0.02 μm or more) are used to lessen the scattering of light as far as possible, a transparent photothermographic material can be produced, which is very advantageous.

Further, when the electroncudctive material is acicular or fibrous, preferably the length is 30 μm or less and the diameter is 2 μm or less, particularly preferably the length is 25 μm or less (generally 1 μm or more) and the diameter is 0.5 μm or less (generally 0.02 μm or more), and the length/diameter ratio is 3 or more.

As the electroconductive high molecular compounds for use in the present invention, e.g., polyvinylbenzene sulfonates, polyvinylbenzyl trimethylammonium chloride, quaternary salt polymers disclosed in U.S. Pat. Nos. 4,108,802, 4,118,231, 4,126,467 and 4,137,217, and polymer latexes disclosed in U.S. Pat. No. 4,070,189, German Patent OLS 2,830,767, JP-A-61-296352 and JP-A-61-62033 are preferably used.

Specific examples of the electroconductive high molecular compounds according to the present invention are shown below but the present invention is not necessarily limited thereto.

CP-1

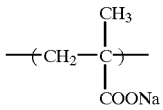

CP-2

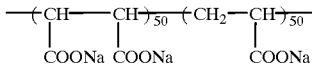

CP-3

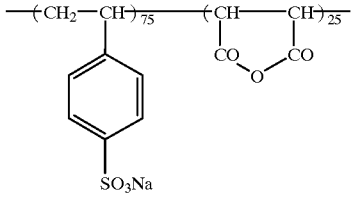

CP-4

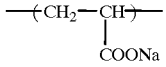

CP-5

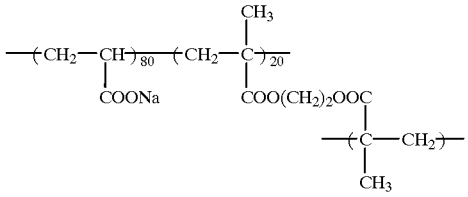

CP-6

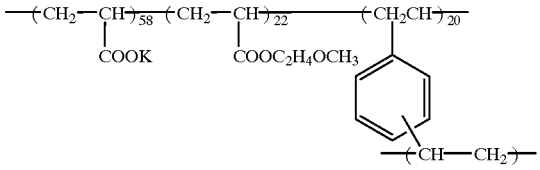

-continued

CP-7

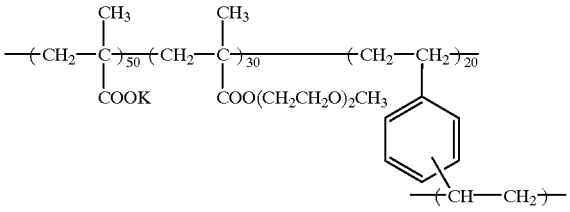

An electroconductive metallic oxide or electroconductive high molecular compound is dispersed or dissolved in a binder before use.

The electroconductive substance particularly preferably used in the present invention is a metallic oxide.

Polymers are used as the binder and any polymer may be used so long as it has film-forming ability, e.g., proteins such as gelatin and casein; cellulose compounds such as carboxymethyl cellulose, hydroxyethyl-cellulose, acetyl cellulose, diacetyl cellulose, and triacetyl cellulose; saccharides such as dextran, agar-agar, sodium alginate, and starch derivatives; and synthetic polymers such as polyvinyl alcohol, polyvinyl acetate, polyacrylic acid ester, polymethacrylic acid ester, polystyrene, polyacrylamide, poly-N-vinyl pyrrolidone, polyester, polyvinyl chloride and polyacrylic acid can be exemplified.

In particular, gelatin (lime-processed gelatin, acid-processed gelatin, enzyme decomposed gelatin, phthalated gelatin, acetylated gelatin, etc.), acetyl cellulose, diacetyl cellulose, triacetyl cellulose, polyvinyl acetate, polyvinyl alcohol, butyl polyacrylate, polyacrylamide, and dextran are preferred.

For reducing the resistance of the electroconductive layer by more effectively using the electroconductive metallic oxide or electroconductive high molecular compound according to the present invention, the volume content of the electroconductive substance in the electroconductive layer is preferably high, but to give sufficient strength to the layer, at least about 5% of a binder is necessary, accordingly the volume content of the electroconductive metallic oxide or electroconductive high molecular compound is preferably from 5 to 95%.

The use amount of the electroconductive metallic oxide or electroconductive high molecular compound according to the present invention is preferably from 0.05 to 20 g, particularly preferably from 0.1 to 10 g, per $m^2$ of the photothermographic material. The surface resistivity of either surface of the photothermographic material of the present invention under the atmosphere of 25° C., 25% RH is $10^{11}\Omega$ or less, preferably $10^{10}\Omega$ or less (generally $10^{4}\Omega$ or more). The surface resistivity is preferably maintained at $10^{11}\Omega$ or less after development processing, thereby good antistatic property can be obtained.

In the present invention, the electroconductive layer containing the electro-conductive metallic oxide or electroconductive high molecular compound is provided on the same side of the support which contains a photosensitive silver halide or on the backing layer side opposite to the photosensitive layer, and an electroconductive material can be contained in any of the constitutional layers of the photothermographic material, e.g., a photosensitive layer containing a photosensitive silver halide (an emulsion layer), a surface protective layer of the emulsion surface, an interlayer, an undercoat layer, a backing layer, and a back surface protective layer. Two or more electroconductive layers may be provided, if necessary. A backing layer (including the undercoat layer of the back surface) and a back surface protective layer are preferred above all.

In the present invention, the photographic material is preferably a single sided material having a photosensitive layer on one surface of the support and having a backing layer on the other side, but a double sided photographic material having photosensitive layers on both surfaces of the support may also the used. The electroconductive layer in such a double sided photographic material is preferably provided as an outermost surface protective layer of the emulsion surface or as an overcoat layer.

In the present invention, if a fluorine-containing surfactant is used in combination with the above-described electroconductive substance, better antistatic property can be obtained.

As the fluorine-containing surfactant preferably used in the present invention, surfactants having a fluoroalkyl, alkenyl or aryl group having 4 or more carbon atoms, and having, as the ionic group, an anionic group (e.g., a sulfonic acid (salt), a sulfuric acid (salt), a carboxylic acid (salt), or a phosphoric acid (salt)), a cationic group (e.g., an amine salt, an ammonium salt, an aromatic amine salt, a sulfonium salt, or a phosphonium salt), a betaine group (e.g., a carboxyamine salt, a carboxyammonium salt, a sulfoamine salt, a sulfoammonium salt, or a phosphoammonium salt), or a nonionic group (e.g., a substituted or unsubstituted polyoxyalkylene group, polyglyceryl group, or a sorbitan residue) can be exemplified.

These fluorine-containing surfactants are disclosed, e.g., in JP-A-49-10722, British Patent 1,330,356, U.S. Pat. Nos. 4,335,201, 4,347,308, British Patent 1,417,915, JP-A-55-149938, JP-A-58-196544 and British Patent 1,439,402. Some specific examples of fluorine-containing surfactants are shown below.

F-1

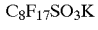

F-2

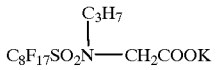

F-3

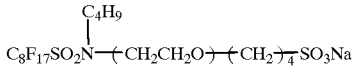

F-4

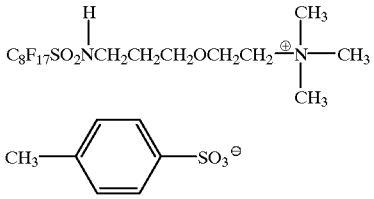

The layer to which the fluorine-containing surfactant according to the present invention is added is not particularly restricted so long as it is any one layer of the photothermographic material, e.g., a surface protective layer, an emulsion layer, an interlayer, an undercoat layer, or a backing layer. A preferred layer of these layers is a surface protective layer, and may be a surface protective layer on either of the emulsion layer side or the backing layer side, but it is more preferred to add the fluorine-containing surfactant to both surface protective layers. When the surface protective layer comprises two or more layers, the fluorine-containing surfactant may be added to any layer and an overcoat layer may further be provided on the surface protective layer.

The amount of the fluorine-containing surfactant to be added is preferably from 0.0001 to 1 g, more preferably from 002to0.25 g, and particularly preferably from 0.0003 to 0.1 g, per $m^2$ of the photothermographic material.

Two or more fluorine-containing surfactants may be used in mixture.

Antistatic agents can be added to the layer containing the fluorine-containing surfactant or other layers, thus more preferred antistatic effect can also be obtained.

The photothermographic material of the present invention is excellent in dust adhesion prevention during processing steps due to the provision of the electroconductive layer to thereby reduce the surface resistivity, thus the photothermographic material of the present invention can deal with the processing line speed of 30 m/min. or more, further, can have the suitability for the processing line speed of 50 m/min. or more (generally 160 m/min. or less).

The photothermographic material according to the present invention is preferably a single sided material comprising at least one photosensitive layer containing a silver halide emulsion on one side of the support and a backing layer on the other side.

In the present invention, an antihalation layer can be provided farther than the photosensitive layer from the light source. It is preferred that an antihalation layer has the maximum absorption in the desired wavelength region, of from 0.2 to 3.0, more preferably from 0.3 to 2, and still more preferably from 0.5 to 2, and the absorption in the visible region after processing is preferably from 0.001 to 0.5, more preferably the antihalation layer is a layer having the optical density of from 0.001 to 0.3.

When antihalation dyes are used in the present invention, any compound can be used so long as it has objective absorption within the wavelength region, shows less absorption in visible region after processing, and provides desirable absorbance spectrum of the antihalation layer. Examples of antihalation dyes are disclosed in the following patents but the present invention is not limited thereto. As a single dye, compounds disclosed in JP-A-59-56458, JP-A-2-216140, JP-A-7-13295, JP-A-7-11432, U.S. Pat. No. 5,380,635, line 1, left lower column, page 13 to line 9, left lower column, page 14 of JP-A-2-68539, and left lower column, page 14 to right lower column, page 16 of JP-A-3-24539, and as a dye which is decolored by processing, compounds disclosed in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734, U.S. Pat. Nos. 4,088,497, 4,283,487, 4,548,896, and 5,187,049 can be used.

It is preferred in the present invention that a decoloring dye and a base precursor are added to the photo-insensitive layer of the photothermographic material to make the photo-insensitive layer function as a filter layer or an antihalation layer. A photothermographic material generally has photo-insensitive layers in addition to photosensitive layers. Photo-insensitive layers can be classified from the arrangement to (1) a protective layer provided on a photosensitive layer (farther side from a support), (2) an interlayer provided between a plurality of photosensitive layers or between a photosensitive layer and a protective layer, (3) an undercoat layer provided between a photosensitive layer and a support, and (4) a backing layer provided on the opposite side to a photosensitive layer. A filter layer is preferably provided in the photothermographic material as a layer of (1) or (2). An antihalation layer is preferably provided in the photothermographic material as a layer of (3) or (4).

A decoloring dye and a base precursor are preferably added to the same photo-insensitive layer but they may be added to two adjacent photo-insensitive layers separately. Further, a barrier layer may be provided between two photo-insensitive layers.

A decoloring dye can be added to the coating solution of the photo-insensitive layer as a solution, an emulsion, a solid fine particle dispersion, or a polymer impregnated product. A dye can also be added to the photo-insensitive layer using a polymer mordant. These addition methods are the same as the methods employed for adding dyes to general photothermographic materials. Latexes for use in polymer impregnated products are disclosed in U.S. Pat. No. 4,199,363, German Patent Publication Nos. 2,541,274 and 2,541,230, EP 029104, and JP-B-53-41091. The emulsifying method for adding a dye to a solution containing a dissolved polymer is disclosed in WO 88/00723.

The addition amount of a decoloring dye is determined by the use of the dye. In general, the optical density when measured at objective wavelength is preferably from 0.2 to 3.0, more preferably from 0.2 to 2.0. The addition amount of the dye for obtaining such optical density is in general from about 0.001 to about 1 $g/m^2$, preferably from about 0.005 to about 0.8 $g/m^2$, and particularly preferably from about 0.01 to about 0.2 $g/m^2$.

Decoloration of the decoloring dyes results in the reduction of optical density to 0.1 or less. Two or more kinds of decoloring dyes may be used in combination in a photothermographic material. Two or more kinds of base precursors may also be used in combination.

In particular, in the present invention, to provide a thermal decoloring type antihalation layer on the back surface side of the support is preferred since residual colors are not caused and a diagnosis can be pronounced without hindrance.

The binders preferably used in the backing layer of the present invention are transparent or translucent and generally colorless. Suitable examples include natural polymers, synthetic resins, polymers and copolymers, in addition, media which can form a film, e.g., gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylic acid), poly(vinyl chloride), poly(methacrylic acid), copoly(styrene-maleic anhydride), copoly(styrene-acrylonitrile), copoly(styrene-butadiene), poly(vinyl acetals) (e.g., poly(vinyl formal) and poly(vinyl butyral)), poly(esters), poly(urethanes), phenoxy resins, poly(vinylidene chloride), poly(epoxides), poly(carbonates), poly(vinyl acetate), cellulose esters, and poly(amides) Binders may be formed from water, an organic solvent or an emulsion by covering.

It is preferred in the present invention that the backing layer has the maximum absorption in the desired wavelength region at exposure, of from 0.2 to 3.0, more preferably from 0.2 to 2, and still more preferably from 0.5 to 2, and the absorption in the visible region after processing is preferably 0.001 to 0.5, more preferably the backing layer is a layer having the optical density of from 0.001 to 0.3. Examples of antihalation dyes for use in the backing layer are the same as those used in the above-described antihalation layer.

Organic silver salts which can be used in the present invention are relatively stable against light but capable of forming a silver image when heated at 80° C. or higher in the presence of an exposed photocatalyst (e.g., a latent image of a photosensitive silver halide and the like) and a reducing agent. Organic silver salts may be arbitrary organic substances containing the source which can reduce silver ions. Such photo-insensitive organic silver salts are disclosed in JP-A-10-62899, paragraphs 0048 to 0049, and EP-A-0803763, line 24, page 18 to line 37, page 19. Silver salts of organic acids, in particular, silver salts of long chain aliphatic carboxylic acids having from 10 to 30, preferably from 15 to 28, of carbon atoms are preferably used in the present invention. Organic silver salts can account for preferably about 5 to 70 wt % of an image-forming layer. Preferred organic silver salts contain silver salts of organic compounds having a carboxyl group. These examples contain silver salts of aliphatic carboxylic acids and silver salts of aromatic carboxylic acids but organic silver salts are not limited thereto. Preferred examples of silver salts of aliphatic carboxylic acids include silver behenate, silver arachidate, silver stearate, silver oleate, silver laurate, silver caproate, silver myristate, silver palmitate, silver maleate, silver fumarate, silver tartrate, silver linoleate, silver butyrate, silver-camphorate, and mixtures of these.

The shape of the organic silver salt which can be used in the present invention is not particularly restricted but scaly organic acid silver salts are preferably used in the present invention. In the present invention, a scaly organic silver salt is defined as follows: An organic acid silver salt is observed with an electron microscope, the shape of the organic acid silver salt particle is approximated to a rectangular parallelopiped, and when the sides of the rectangular parallelopiped are taken as a, band c from the shortest (c maybe equal to b), x is calculated from the shorter numeric values a and b as follows:

$$x=b/a$$

x is obtained as to about 200 particles by the above equation, and when the average value is taken as x (average), those satisfying the relationship "x (average) $\geqq 1.5$" are regarded as scaly particles, preferably $30 \geqq x$ (average) $\geqq 1.5$, more preferably $20 \geqq x$ (average) $\geqq 2.0$. In this connection, acicular particles satisfy the relation "$1 \geqq x$ (average) $<1.5$".

In a scaly particle, a can be regarded as a thickness of a tubular particle having a plane with b and c as the sides as a main plane. The average of a is preferably from 0.01 to 0.23 $\mu$m, and more preferably from 0.1 to 0.20 $\mu$m . The average of c/b is preferably from 1 to 6, more preferably from 1.05 to 4, still more preferably from 1.1 to 3, and particularly preferably from 1.1 to 2.

The particle size distribution of an organic silver salt is preferably monodispersion. Monodispersion means that the values in terms of percentage obtained by dividing the standard deviations of the respective lengths of short axis and long axis by the respective lengths of short axis and long axis respectively are preferably 100% or less, more preferably 80% or less, and most preferably 50% or less The shape of organic silver salt can be obtained from the transmission electron microscopic image of an organic silver salt dispersion product. As another method of measuring monodispersing property, a method of obtaining the standard deviation of the volume weighted average diameter of an organic silver salt can be used. The value obtained in terms of percentage (variation coefficient) by dividing the standard deviation of the volume weighted average diameter by the volume weighted average diameter is preferably 100% or less, more preferably 80% or less, and most preferably 50% or less. The volume weighted average diameter can be obtained from the particle size (volume weighted average diameter) obtained by irradiating the organic silver salt dispersed in a solution with laser beams, and finding the autocorrelation function to the time variation of fluctuation of light scattering.

Silver organic acid for use in the present invention can be produced by reacting the solution or the suspension of the above-described alkali metal salts (e.g., Na salt, K salt, Li salt) of organic acids with silver nitrate. Organic acid alkali metal salts according to the present invention can be obtained by the alkali treatment of the above organic acids. Silver organic acid of the present invention can be produced in an appropriate reaction vessel in a batch system or continuous system. Stirring in a reaction vessel can be arbitrarily selected according to the characteristics required of particles. Any of the following methods can be preferably used in the present invention for producing silver organic acid, e.g., a method of gradually or hastily adding a silver nitrate aqueous solution to a reaction vessel containing a solution or a suspension of organic acid alkali metal salt, a method of gradually or hastily adding a previously prepared solution or suspension of organic acid alkali metal salt to a reaction vessel containing a silver nitrate aqueous solution, and a method of simultaneously adding a previously prepared silver nitrate aqueous solution and solution or suspension of organic acid alkali metal salt to a reaction vessel.

A silver nitrate aqueous solution and a solution or a suspension of organic acid alkali metal salt can be used respectively in arbitrary concentrations for adjusting the particle size of the silver organic acid to be prepared, and they can be added at arbitrary addition rates. A silver nitrate aqueous solution and a solution or a suspension of organic acid alkali metal salt can be added at constant addition rates or can be added at accelerated or decelerated addition rates according to arbitrary time functions. They may be added to the liquid level or in the liquid of the reaction solution. When a previously prepared silver nitrate aqueous solution and solution or suspension of organic acid alkali metal salt are simultaneously added to a reaction vessel, either can precede but the addition of a silver nitrate aqueous solution preferably precedes. The precedence degree is preferably from 0 to 50 vol %, and particularly preferably from 0 to 25 vol %, of the total addition amount. The method of addition with controlling the pH or the silver potential of the reaction solution during reaction as disclosed in JP-A-9-127643 is also preferably used. pH values of a silver nitrate aqueous solution and a solution or a suspension of organic acid alkali metal salt to be added can be adjusted according to characteristics required of the particles. Arbitrary acids or alkalis can be added for adjusting pH. Further, according to characteristics required of the particles, the temperature in the reaction vessel can be selected optionally, for example, for controlling the particle size of the silver organic acid to be produced. The temperatures of a silver nitrate aqueous solution and a solution or a suspension of organic acid alkali metal salt to be added can also be adjusted arbitrarily. For ensuring the flowability, the temperature of a solution or a suspension of organic acid alkali metal salt is preferably maintained at 50° C. or higher.

It is preferred to produce the silver organic acid for use in the present invention in the presence of tertiary alcohols. The tertiary alcohols for use in the present invention preferably have total carbon atoms of 15 or less, more preferably 10 or less. As a preferred tertiary alcohol, tert-butanol can be exemplified but the present invention is not limited thereto.

Tertiary alcohols for use in the present invention can be added at any stage of the production of silver organic acid but are preferably added during preparation of organic acid alkali metal salt to dissolve the organic acid alkali metal salt before use. The use amount of tertiary alcohols according to the present invention is from 0.01 to 10, preferably from 0.03 to 1, by weight ratio based on $H_2O$ as a solvent in the production of the silver organic acid.

When an aqueous solution containing a water-soluble silver salt and an aqueous tertiary alcohol solution containing an organic acid alkali metal salt are reacted in a reaction vessel (including the step of adding the aqueous tertiary alcohol solution containing an organic acid alkali metal salt to the solution in the reaction vessel), it is preferred to produce the scaly silver salt of organic acid preferably used in the present invention in a manner so as to make the temperature difference between the solution in the reaction vessel (preferably the aqueous solution containing a water-soluble silver salt added to the reaction vessel in advance, or in the case when the aqueous solution containing a water-soluble silver salt is not previously added but is added simultaneously with the aqueous tertiary alcohol solution containing an organic acid alkali meat salt from the first, the solution in the reaction vessel is water or a mixed solvent of water and a tertiary alcohol as later described, further also in the case when the aqueous solution containing a water-soluble silver salt is added to the reaction vessel in advance, water or a mixed solvent of water and a tertiary alcohol may previously be added to the vessel) and the aqueous tertiary alcohol solution containing an organic acid alkali metal salt to be added to the reaction vessel from 20° C. to 85° C.

By maintaining the temperature difference during the addition of the aqueous tertiary alcohol solution containing an organic acid alkali metal salt, the crystal form of the silver salt of organic acid is advantageously controlled.

As this water-soluble silver salt, silver nitrate is preferred, and the concentration of the water-soluble silver salt in the aqueous solution is preferably from 0.03 to 6.5 mol/liter, more preferably from 0.1 to 5 mol/liter, and the pH of the aqueous solution is preferably from 2 to 6, more preferably from 3.5 to 6.

A tertiary alcohol having from 4 to 6 carbon atoms may be contained in the aqueous solution containing a water-soluble silver salt, and in such a case the content of the tertiary alcohol is 70% by volume or less, preferably 50% by volume or less, based on the total volume of the aqueous solution containing a water-soluble silver salt. The temperature of the aqueous solution is preferably from 0° C. to 50° C., more preferably from 5° C. to 30° C. When the aqueous solution containing a water-soluble silver salt is added simultaneously with the aqueous tertiary alcohol solution containing an organic acid alkali metal salt, the temperature is most preferably from 5° C. to 15° C. as described later.

The alkali metals of the organic acid alkali metal salt is specifically Na and K. Organic acid alkali metal salt is produced by adding NaOH or KOH to an organic acid. It is preferred to make the weight of the alkali equivalent or less of the weight of the organic acid at that time to leave an unreacted organic acid. The residual organic acid amount at this time is from 3 to 50 mol %, preferably from 3 to 30 mol %, per mol of the entire organic acid. Further, alkali of the amount larger than the prescribed amount is added and the excess amount of alkali may be neutralized afterward by adding an acid such as a nitric acid or a sulfuric acid.

Further, pH can be adjusted by the required characteristics of the organic acid silver salt. For pH adjustment, arbitrary acids and alkalis can be used.

There may be added to the aqueous solution containing a water-soluble silver salt, the aqueous tertiary alcohol solution containing an organic acid alkali metal salt, or the solution in the reaction vessel, for example, a compound represented by formula (1) as disclosed in JP-A-62-65035, an N heterocyclic compound containing a water-soluble group as disclosed in JP-A-62-150240, an inorganic peroxide as disclosed in JP-A-50-101019, a sulfur compound as disclosed in JP-A-51-78319, a disulfide compound as disclosed in JP-A-57-643, or a hydrogen peroxide.

The aqueous tertiary alcohol solution containing an organic acid alkali metal salt according to the present invention is preferably a mixed solvent or a tertiary alcohol having from 4 to 6 carbon atoms and water for obtaining the homogeneity of the solution. If the carbon atom number exceeds this range, the compatibility with water is deteriorated, which is not advantageous. Of tertiary alcohols having from 4 to 6 carbon atoms, tert-butanol which is most compatible with water is most preferred. Since alcohols other than tertiary alcohols have reducibility, harmful influences are disadvantageously caused in the formation of the silver salt of organic acid as described above. The content of the tertiary alcohols contained in the aqueous tertiary alcohol solution containing an organic acid alkali metal salt is from 3 to 70%, preferably from 5 to 50%, by volume of the solvent based on the volume of the aqueous content in the aqueous tertiary alcohol solution.

The concentration of the organic acid alkali metal salt in the aqueous tertiary alcohol solution containing an organic acid alkali metal salt for use in the present invention is from 7 to 50 wt %, preferably from 7 to 45 wt %, and more preferably from 10 to 40 wt %, by weight ratio.

The temperature of the aqueous tertiary alcohol solution containing an organic acid alkali metal salt added to the reaction vessel is preferably from 50 to 90° C., more preferably from 60 to 85° C., and most preferably from 65 to 85° C., for the purpose of maintaining the necessary temperature to prevent phenomena such as crystallization and solidification of the organic acid alkali metal salt. The Temperature is preferably controlled at a certain temperature selected from the above range throughout the reaction.

The silver salt of organic acid according to the present invention is produced by i) the method in which the total amount of the aqueous solution containing a water-soluble silver salt is added to the reaction vessel in advance and then the aqueous tertiary alcohol solution containing an organic acid alkali metal salt is added thereto (a single addition method), or ii) the method in which the aqueous solution containing a water-soluble silver salt and the aqueous tertiary alcohol solution containing an organic acid alkali metal salt are added simultaneously at least for some period of time (a simultaneous addition method). The latter simultaneous addition method is preferably used in the present invention for controlling the average particle size of the silver salt of organic acid and making the particle size distribution narrow. In such a case, preferably 30 vol % or more, more preferably from 50 to 75 vol %, of the total addition amount is added simultaneously. When either one is added beforehand, the aqueous solution containing a water-soluble silver salt is preferably added first.

In any case, the temperature of the solution in the reaction vessel (as described above, the aqueous solution containing a water-soluble silver salt added in advance, or when the aqueous solution containing a water-soluble silver salt is not added precedently, the solvent previously added in the reaction vessel as described later) is preferably from 5° C. to 75° C., more preferably from 5° C. to 60° C., and most preferably from 10° C. to 50° C. The temperature is preferably controlled at a certain temperature selected from the above range throughout the reaction, but it is also preferred to control the temperature in some patterns within the above range.

In the present invention, the temperature difference between the aqueous tertiary alcohol solution containing an organic acid alkali metal salt and the solution in the reaction vessel is preferably from 20° C. to 85° C., more preferably from 30° C. to 80° C. In this case, it is preferred that the temperature of the aqueous tertiary alcohol solution containing an organic acid alkali metal salt is higher than that of the solution in the reaction vessel.

Thus, the rate of crystallite-like precipitation of the aqueous tertiary alcohol solution containing an organic acid alkali metal salt of high temperature as a result of quenching in the reaction vessel and the rate of coming into a silver salt of organic acid by the reaction with the water-soluble silver salt are preferably controlled. As a result, the crystal shape, the crystal size and the crystal size distribution of the silver salt of organic acid can be preferably controlled. At the same time, the performances of the photothermographic material can be further improved.

A solvent may be put in a reaction vessel in advance, e.g., water is preferably used as a solvent previously added and a mixed solvent of a tertiary alcohol with water is also preferably used.

An auxiliary dispersant (i.e., a dispersing aid) which is soluble in an aqueous medium can be added to the aqueous tertiary alcohol solution containing an organic acid alkali metal and the aqueous solution containing a water-soluble silver salt according to the present invention, or the reaction solution. Any compound can be used as the auxiliary dispersant so long as it can disperse the silver salt of organic acid formed. Specific examples correspond to the auxiliary dispersants of the silver salt of organic acid described later.

In the preparing method of the silver salt of organic acid according to the present invention, it is preferred to perform desalting/dehydrating process after silver salt formation. Methods of desalting/dehydrating are not particularly restricted and well-known conventional means can be utilized. For example, well-known filtration methods such as centrifugal filtration, suction filtration, ultrafiltration, and washing of floc formed by agglomeration can be preferably used The removal of a supernatant by centrifugal separation sedimentation is also preferably used. Desalting/dehydrating may be performed only one time or may be repeated a plurality of times. Addition and removal of water may be performed continuously or separately. Desalting/dehydrating is performed until the conductivity of the dehydrated water finally reaches preferably 300 μS/cm or less, more preferably 100 μS/cm or less, and most preferably 60 μS/cm or less. The lower limit of the conductivity in this case is not particularly limited but is generally about 5 μS/cm.

Further, for improving the coating surface condition of a photothermographic material, it is preferred to prepare a water dispersion of a silver salt of organic acid, convert the obtained dispersion to high flow rate by high pressure, and redisperse by pressure drop to obtain a fine water dispersion. The dispersion medium at this time is preferably water alone, but an organic solvent may be contained if the amount is 20 wt % or less.

A silver salt of organic acid can be mechanically finely dispersed in the presence of an auxiliary dispersant using well-known dispersing means (e.g., a high speed mixer, a homogenizer, a high speed impacting mill, a banbury mixer, a homomixer, a kneader, a ball mill, a vibrating ball mill, a planetary ball mill, an attritor, a sand mill, a beads mill, a colloid mill, a jet mill, a roller mill, a trommel and a high speed stone mill).

If a photosensitive silver salt is present with the silver salt of organic acid during dispersion, fog increases and sensitivity extremely lowers. Thus, it is more preferred not to substantially contain a photosensitive silver salt in the water dispersion solution. The content of a photosensitive silver salt in the water dispersion solution to be dispersed is 0.1 mol % or less per mol of the silver salt of organic acid in the solution, where the addition of a photosensitive silver salt is not performed positively.

In the present invention, for obtaining a solid dispersion of organic silver salt having a high S/N ratio, a small particle size, without agglomeration and homogeneous, it is preferred to give large force within the range not to cause the breakage and the temperature increase of organic silver salt particles which are image-forming media. For the above purpose, a dispersing method in which the flow rate of a water dispersion product comprising an organic silver salt and an aqueous solution of dispersant is converted to a high flow rate and then the pressure is lowered is preferably used.

Dispersing apparatuses and techniques for performing the foregoing redispersion are described in detail, for example, in Toshio Kajiuchi, Hiroshi Usui, *Rheology of Dispersion System and Techniques of Dispersion*, pp. 357 to 403, Shinoyama Publishing Co., Ltd. (1991), *Advancement of Chemical Engineering*, the 24th Series, pp. 184 and 185, compiled by the Tokai Branch of the Chemical Engineering Society, published by Maki Shoten (1990), JP-A-59-49832, U.S. Pat. No. 4,533,254, JP-A-8-137044, JP-A-8-238848, JP-A-2-261525, JP-A-1-94933, etc. The redispersing method according to the present invention is a method in which a water dispersion solution containing at least a silver salt of organic acid is fed to piping by high pressure using a high pressure pump and the like, passed through a fine slit in the piping, and then the pressure applied to the dispersion solution is suddenly reduced to thereby effect fine dispersion.

The reason why the dispersion to fine particles can be brought about uniformly and effectively by using a high pressure homogenizer according to the present invention is thought to be due to (a) "shear force" is generated when a dispersoid passes through a narrow gap (from about 75 μm to about 350 μm) at high pressure and a high flow rate, and (b) impact force generated during liquid-liquid impinging under high pressure and narrow gap and impinging against wall further strengthens cavitation force generated by the pressure drop thereafter. As a dispersing apparatus of this type, a Gaulin homogenizer has so far been used, wherein a solution to be dispersed fed at high pressure is converted to high flow rate in a narrow gap on cylindrical plane, the solution is impinged against the surrounding walls by that force, and emulsification and dispersion are effected by that impact force. As the apparatus of the above liquid-liquid impinging, Y-type chamber of micro-fluidizer, a spherical chamber making use of spherical check valves as disclosed in JP-A-8-103642 described later, etc., can be exemplified, and as liquid-wall impinging, Z-type chamber of micro-fluidizer, etc., can be exemplified. The applied pressure is in general within the range of from 100 to 600 kg/cm$^2$ and a flow rate is from several meters to 30 meters/second, and some means have been elaborated to heighten a dispersion efficiency, such as to provide sawtooth blades at high flow rate zone to increase the number of times of impinging. As representative examples of this type of apparatus, a Gaulin homogenizer, a micro-fluidizer (manufactured by Micro Fluidex International Corp.), a micro-fluidizer (manufactured by Mizuho Kogyo Co., Ltd.), and a nanomizer (manufactured by Tokushu Kika Kogyo Co., Ltd.) are exemplified. Similar apparatuses are also disclosed in JP-A-8-238848, JP-A-8-103642 and U.S. Pat. No. 4,533,254.

In the present invention, it is possible to achieve the dispersion of the silver salt of organic acid of the desired particle size by adjusting flow rate, differential pressure at the time of pressure drop, and the number of times of processing. From the viewpoint of the photographic characteristics and the particle size, the flow rate is preferably from 200 to 600 m/second, more preferably from 300 to 600 m/ second, and differential pressure at pressure drop is preferably from 900 to 3,000 kg/cm$^2$, more preferably from 1,500 to 3,000 kg/cm$^2$. The number of times of dispersion processing can be selected according to necessity and, in general, from 1 to 10 times, but in view of productivity, preferably from about 1 to about 3. It is not preferred in the light of dispersion properties and photographic characteristics to maintain the temperature of a water dispersion solution high under high pressure, and when the temperature exceeds 90° C., the particle size is liable to increase and fog is also liable to increase. Accordingly, it is preferred in the present invention to include a cooling process in steps prior to conversion to high pressure/high flow rate, after pressure drop, or in both steps, to thereby maintain the temperature of the water dispersion preferably from 5 to 90° C., more preferably from 5 to 80° C., and particularly preferably from 5 to 65° C. In particular, it is effective to provide such a cooling process during high pressure dispersion of from 1,500 to 3,000 kg/cm$^2$. A cooling apparatus (i.e., a cooler) can be arbitrarily selected from, e.g., a double pipe and a triple pipe using a static mixer, a multitubuler heat exchanger, and a coiled heat exchanger, according to the required heat exchange amount. Further, for increasing heat exchange efficiency, it is necessary to select appropriate diameter, thickness and material of the pipe with taking the pressure used into consideration. As a cooling medium in a cooler, well water of 20° C., chilled water of from 5 to 10° C. treated with a refrigerator, or, if necessary, a cooling medium such as ethylene glycol/water of −30° C. can be used according to heat exchange amount.

When a solid fine particle atomization of a silver salt of organic acid is carried out using a dispersant, the following dispersants can be arbitrarily selected, e.g., synthetic anion polymers such as polyacrylic acid, acrylic acid copolymers, maleic acid copolymers, maleic acid monoester copolymers, and acryloylmethylpropane sulfonic acid copolymers, semi-synthetic anion polymers such as carboxymethyl starch and carboxymethyl cellulose, anionic polymers such as alginic acid and pectic acid, anionic surfactants disclosed in JP-A-52-92716 and WO 88/04794, compounds as disclosed in JP-A-9-179243, well-known anionic, nonionic and cationic surfactants, other well-known polymers such as polyvinyl alcohol, polyvinyl pyrrolidone, carboxymethyl cellulose, hydroxypropyl cellulose, and hydroxypropylmethyl cellulose, and natural high molecular compounds such as gelatin.

An auxiliary dispersant (i.e., a dispersing aid) is in general mixed with the powder of a silver salt of organic acid or a silver salt of organic acid in a wet cake-like state before dispersion and fed to a dispersing apparatus as a slurry. Alternatively, an auxiliary dispersant may be previously mixed with a silver salt of organic acid and subjected to heat treatment or treatment with a solvent and then made into a powder or wet cake of the silver salt of organic acid. pH adjustment may be performed before, after or during dispersion with an appropriate pH adjustor.

In addition to mechanical dispersion, silver salt of organic acid may be coarsely dispersed in a solvent by pH controlling, and then atomized by changing pH in the presence of an auxiliary dispersant. At this time, an organic solvent may be used for coarse dispersion and the organic solvent is in general removed after completion of the atomization.

The prepared dispersion product can be preserved with stirring or in a highly viscous state with hydrophilic colloid (for example, in a jelly-like state using gelatin) for the purpose of preventing the sedimentation of fine particles during preservation. Further, it is preferred to add preservatives for inhibiting the proliferation of various bacteria during preservation.

The silver salt of organic acid prepared according to the producing method of the silver salt of organic acid of the present invention is preferably dispersed in a water solvent, mixed with an aqueous photosensitive silver salt solution, and supplied as a coating solution for a photosensitive image-forming medium.

A starting solution is subjected to coarse dispersion (preliminary dispersion) prior to dispersing operation. As coarse dispersing means, known dispersing means, e.g., a high speed mixer, a homogenizer, a high speed impacting mill, a banbury mixer, a homomixer, a kneader, a ball mill, a vibrating ball mill, a planetary ball mill, an attritor, a sand mill, a beads mill, a colloid mill, a jet mill, a roller mill, a trommel and a high speed stone mill, can be used. In addition to mechanical dispersion, a starting material may be coarsely dispersed in a solvent by pH controlling, and then atomized by changing pH in the presence of an auxiliary dispersant. At this time, an organic solvent may be used for coarse dispersion and the organic solvent is in general removed after completion of the atomization.

After having been atomized, the aqueous photosensitive silver salt solution is mixed with the silver salt of organic acid to prepare a coating solution of a photosensitive image-forming medium. The thus-prepared coating solution makes it possible to obtain a photothermographic material exhibiting low haze, low fog and high sensitivity. On the contrary, if a photosensitive silver salt is present with the silver salt of organic acid when dispersion is performed by conversion to high pressure and high flow rate, fog increases and sensitivity is liable to be extremely lowered. If an organic solvent is used as a dispersion medium in place of water, haze is heightened, fog increases, and sensitivity is liable to be lowered. While when a conversion method comprising converting a part of the organic silver salt in the dispersion solution to a photosensitive silver salt is employed instead of the method of mixing a photosensitive silver salt aqueous solution, sensitivity is liable to be lowered.

In the above, a water dispersion solution which is dispersed by high pressure and high flow rate conversion does not substantially contain a photosensitive silver salt and the content thereof is 0.1 mol % or less based on the photo-insensitive organic silver salt, where the addition of a photosensitive silver salt is not performed positively.

The particle size of the organic silver salt solid fine particle dispersion (volume weighted average diameter) according to the present invention can be obtained from the particle size (volume weighted average diameter) obtained by irradiating the solid fine particle dispersion dispersed in a solution with laser beams, and finding the autocorrelation function to the time variation of fluctuation of light scattering. A solid fine particle dispersion preferably has the average particle size of from 0.05 to 10.0 $\mu$m, more preferably from 0.1 to 5.0 $\mu$m, and most preferably from 0.1 to 2.0 $\mu$m.

The organic silver salt solid fine particle dispersion for use in the present invention comprises at least an organic silver salt and water. The ratio of an organic silver salt and water is not particularly limited, but preferably an organic silver salt accounts for from 5 to 50 wt %, particularly preferably from 10 to 30 wt %, of the total composition. The foregoing auxiliary dispersant is preferably used but the use amount is preferably the possible minimum amount within the range capable of obtaining the smallest particle size. The amount is preferably from 1 to 30 wt %, particularly preferably from 3 to 15 wt %, based on the organic silver salt.

A photothermographic material can be prepared by mixing a water dispersion solution of an organic silver salt and a water dispersion solution of a photosensitive silver salt according to the present invention. The mixing ratio of an organic silver salt and a photosensitive silver salt can be selected according to purposes, but the ratio of a photosensitive silver salt to an organic silver salt is preferably from 1 to 30 mol %, more preferably from 3 to 20 mol %, and particularly preferably from 5 to 15 mol %. Mixture of two or more kinds of water dispersion solutions of organic silver salts and two or more kinds of water dispersion solutions of photosensitive silver salts is preferably used for adjusting photographic characteristics.

The organic silver salt according to the present invention can be used in a desired amount but the amount is preferably from 0.1 to 5 $g/m^2$, more preferably from 1 to 3 $g/m^2$, as silver amount, of the photothermographic material.

The photothermographic material of the present invention contains a reducing agent for organic silver salts. A reducing agent for organic silver salts may be an arbitrary substance for reducing silver ions to metal silver, preferably an organic substance. Conventional photographic developers such as phenidone, hydroquinone and catechol are useful, but hindered phenol reducing agents are preferably used, e.g., bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane. Such reducing agents are disclosed in JP-A-10-62899, paragraphs 0052 to 0053, and EP-A-0803764, line 34, page 7 to line 12, page 18.

The addition amount of a reducing agent is preferably from 0.01 to 5.0 $g/m^2$, more preferably from 0.1 to 3.0 $g/m^2$. A reducing agent is preferably contained in an amount of from 5 to 50 mol %, more preferably from 10 to 40mol %, per mol of the silver contained on the side on which an image-forming layer is provided. A reducing agent may be added to any layer provided on the side on which an image-forming layer is provided. When a reducing agent is added to layers other than an image-forming layer, it is preferred to use somewhat much amount, e.g., from 10 to 50 mol % per mol of the silver. A reducing agent may be a so-called precursor which has been derived to have a function effectively only at the time of development.

A reducing agent for use in the present invention may be added in any form, e.g., a solution, a powder, or a solid fine particle dispersion. Solid fine particle dispersion is performed using well-known atomizing means, e.g., a ball mill, a vibrating ball mill, a sand mill, a colloid mill, a jet mill, a roller mill, etc. An auxiliary dispersant may be used for solid fine particle dispersion.

The halogen composition of the photosensitive silver halide for use in the present invention is not limited in particular. Silver chloride, silver chlorobromide, silver bromide, silver iodobromide, and silver iodochlorobromide can be used in the present invention. The distribution of the halogen composition in the grain may be uniform, the halogen composition may be changed stepwise or may be continuously changed. Silver halide grains having a core/shell structure can be preferably used. Grain structures are preferably from a double structure to a quintuple structure. Core/shell grains having a double structure to a quadruple structure can be more preferably used. Techniques of localizing silver bromide on the surface of silver chloride or silver chlorobromide grains can preferably be used.

The photosensitive silver halide for use in the present invention can be produced using the methods well-known in this industry, for example, the methods disclosed in *Research Disclosure*, No. 17029 (June, 1978) and U.S. Pat. No. 3,700,458 can be used. Specifically, photosensitive silver halide is produced by adding a silver-supplying compound and a halogen-supplying compound to gelatin or other polymer solution, then mixing with an organic silver salt.

The grain size of photosensitive silver halide is preferably small for the purpose of suppressing the white turbidity after image formation to low degree, specifically preferably 0.20 $\mu$m or less, more preferably from 0.01 to 0.15 $\mu$m, and still more preferably from 0.02 to 0.12 $\mu$m . The grain size in the present invention means the edge length when silver halide grains have a so-called regular crystal form such as a cubic or octahedral form, when silver halide grains do not have regular crystal forms, e.g., in the case of a spherical or cylindrical form, the grain size means the diameter of the sphere having the same volume as the volume of the silver halide grains, and when silver halide grains are tabular grains it means the diameter of a circle having the same area as the projected area of the main plane of the grain.

Silver halide grains may have a crystal form such as a cubic, octahedral, tabular, spherical, cylindrical, or pebble-like form. Cubic grains and tabular grains are particularly preferably used in the present invention. When tabular silver halide grains are used, they preferably have an average aspect ratio of from 100/1 to 2/1, more preferably from 50/1 to 3/1. Silver halide grains having rounded corners can also be preferably used in the present invention. A face index (Miller index) of the outer surface of photosensitive silver halide grains is not particularly limited, but it is preferred that the proportion occupied by {100} faces which have high ratio of spectral sensitizing efficiency when spectral sensitizing dyes are adsorbed is high. The proportion of {100} face is preferably 50% or more, more preferably 65% or more, and still more preferably 80% or more. The ratio of Miller index { 100} face can be obtained by the method described in T. Tani, *J. Imaging Sci.*, 29, 165 (1985), which makes use of adsorption dependence of {111} face and {100} face in adsorption of sensitizing dyes.

The photosensitive silver halide grains for use in the present invention contain metals or metal complexes belonging to groups VII or VIII (from group 7 to group 10) of the Periodic Table. Preferred central metals or metal complexes belonging to groups VII or VIII of the Periodic Table are rhodium, rhenium, ruthenium, osmium and iridium. These metal complexes may be used alone, or two or more of the complexes of the same or different metals can be used in combination. The content of these metals or metal complexes is preferably from $1\times10^{-9}$ mol to $1\times1^{-3}$ mol, more preferably from $1\times1^{-8}$ mol to $1\times1^{-4}$ mol, per mol of the silver. Specific structures of the metal complexes which can be used in the present invention are disclosed in JP-A-7-225449.

Water-soluble rhodium compounds can be used as a rhodium compound in the present invention, for example, rhodium(III) halide compounds, or rhodium complex salts having halogen, amines, or oxalato as a ligand, such as hexachlororhodium(III) complex salts, pentachloroaquorhodium(III) complex salts, tetrachlorodiaquorhodium(III) complex salts, hexabromorhodium(III) complex salts, hexaamminerhodium(III) complex salts, trioxalatorhodium (III) complex salts and the like. These rhodium compounds are dissolved in water or an appropriate solvent before use A conventional method such as a method in which an aqueous solution of hydrogen halide (e.g., hydrochloric acid, hydrobromic acid, hydrofluoric acid) or alkali halide (e.g., KCl, NaCl, KBr, NaBr) is added to the solution of rhodium compound to stabilize the solution can be used. It is also possible to add and dissolve other silver halide grains which have been previously doped with rhodium during the preparation of silver halide instead of using water-soluble rhodium.

The addition amount of these rhodium compounds is preferably from $1\times10^{-8}$ mol to $5\times10^{-6}$ mol, and particularly preferably from $5\times10^{-8}$ mol to $1\times10^{-6}$ mol, per mol of the silver halide.

These compounds can be added optionally during the preparation of silver halide emulsion grains and at any stage prior to coating of the emulsion, but they are particularly preferably added during emulsion formation and incorporated into the silver halide grains.

Rhenium, ruthenium, and osmium for use in the present invention are added in the form of water-soluble complex salts as disclosed in JP-A-63-2042, JP-A-1-285941, JP-A-2-20852 and JP-A-2-20855. Particularly preferred compounds are hexahedral complexes represented by the following formula:

$$[ML_6]^{n-}$$

wherein M represents Ru, Re or Os, L represents a ligand, and n represents 0, 1, 2, 3 or 4.

In this case, counter ions are not important and ammonium or alkali metal ions are used.

Examples of preferred ligands include a halide ligand, a cyanide ligand, a cyano-oxide ligand, a nitrosyl ligand, and a thionitrosyl ligand. Specific examples of complexes for use in the present invention are shown below but the present invention is not limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{1-}$ | $[RuCl_5(H_2O)]^{2-}$ |
| $[RuCl_5(NO)]^{2-}$ | $[RuBr_5(NS)]^{2-}$ | $[Ru(CO)_3Cl_3]^{2-}$ |
| $[Ru(CO)Cl_5]^{2-}$ | $[Ru(CO)Br_5]^{2-}$ | $[OsCl_6]^{3-}$ |
| $[OsCl_5(NO)]^{2-}$ | $[Os(NO)(CN)_5]^{2-}$ | $[Os(NS)Br_5]^{2-}$ |
| $[Os(O)_2(CN)_4]^{4-}$ | | |

The addition amount of these compounds is preferably from $1\times10^{-9}$ mol to $1\times10^{-5}$ mol, and particularly preferably from $1\times10^{-8}$ mol to $1\times10^{-6}$ mol, per mol of the silver halide.

These compounds can be added optionally during the preparation of silver halide emulsion grains and at any stage prior to coating of the emulsion, but they are particularly preferably added during emulsion formation and incorporated into the silver halide grains.

Various methods can be used for adding these compounds during grain formation of silver halide and incorporating them into silver halide grains, for example, a method in which a metal complex powder per se or an aqueous solution dissolved therein a metal complex powder with NaCl and KCl is previously added to a solution of water-soluble salt or water-soluble halide for grain formation, a method in which a metal complex powder is simultaneously added as the third solution when a solution of silver salt and a solution of halide are mixed to prepare silver halide grains by a triple jet method by three solutions, or a method in which a necessary amount of an aqueous solution of a metal complex powder is added to a reaction vessel during grain formation. A method of adding a metal complex powder per se or an aqueous solution dissolved therein a metal complex powder with NaCl and KCl to a water-soluble halide solution is particularly preferred.

When these compounds are added to the surfaces of grains, a necessary amount of an aqueous solution of metal complexes can be added to a reaction vessel immediately after grain formation, during or at finishing of physical ripening, or during chemical ripening.

Various iridium compounds can be used in the present invention, for example, hexachloroiridium, hexaammineiridium, trioxalatoiridium, hexacyanoiridium, pentachloronitrosyliridium and the like can be exemplified. These iridium compounds are dissolved in water or an appropriate solvent and used. A conventional method such as a method in which an aqueous solution of hydrogen halide (e.g., hydrochloric acid, hydrobromic acid, hydrofluoric acid) or alkali halide (e.g., KCl, NaCl, KBr, NaBr) is added to stabilize the solution of iridium compound can be used. It is also possible to include and dissolve other silver halide grains which have been previously doped with iridium during the preparation of silver halide instead of using water-soluble iridium. The addition amount of these iridium compounds is preferably from $1\times10^{-8}$ mol to $1\times10^{-3}$ mol, and more preferably from $1\times10^{-7}$ mol to $5\times10^{-4}$ mol, per mol of the silver halide.

Further, the silver halide grains for use in the present invention may contain metal atoms such as cobalt, iron, nickel, chromium, palladium, platinum, gold, thallium, copper, or lead. With respect to cobalt, iron, chromium and ruthenium compounds, hexacyano metal complexes can preferably be used. Specifically, a ferricyanic acid ion, a ferrocyanic acid ion, a hexacyanocobaltic acid ion, a hexacyanochromic acid ion and a hexacyanoruthenic acid ion can be exemplified, but the present invention is not limited thereto. Metal complexes may be contained in silver halide uniformly, may be contained in high concentration in a core part, or may be contained in high concentration in a shell part without any limitation.

The preferred addition amount of these metals is from $1\times10^{-9}$ mol, to $1\times10^{-4}$ mol per mol of the silver halide. Further, these metals can be added as a metal salt in the form of a single salt, a double salt or a complex salt during the preparation of grains.

Photosensitive silver halide grains can be desalted by washing according to methods well-known in this industry, e.g., a noodle washing method or a flocculation method, but silver halide grains may be or may not be desalted in the present invention.

The silver halide emulsion of the present invention is preferably chemically sensitized. Conventionally known chemical sensitization methods such as sulfur sensitization, selenium sensitization, tellurium sensitization and noble metal sensitization can be used.

A plurality of chemical sensitizations can be used in combination, e.g., a combination of sulfur sensitization and gold sensitization, a combination of sulfur sensitization and selenium sensitization or tellurium sensitization, a combination of gold sensitization and selenium sensitization or tellurium sensitization, a combination of sulfur sensitization and selenium sensitization or tellurium sensitization and gold sensitization, a combination of sulfur sensitization, selenium sensitization and tellurium sensitization, and a combination of sulfur sensitization, selenium sensitization, tellurium sensitization and gold sensitization can be exemplified.

The sulfur sensitization preferably used in the present invention is usually carried out by adding a sulfur sensitizer and stirring the emulsion at high temperature of 40° C. or more for a certain period of time. Various well-known sulfur compounds can be used as a sulfur sensitizer, for example, in addition to sulfur compounds contained in gelatin, various sulfur compounds, e.g., thiosulfates, thioureas, thiazoles, and rhodanines. Preferred sulfur compounds are thiosulfates and thioureas. The addition amount of a sulfur sensitizer varies in accordance with various conditions such as the pH and temperature during chemical ripening and the grain size of the silver halide grains, but is preferably from $1\times10^{-7}$ to $1\times10^{-2}$ mol and more preferably from $1\times10^{-5}$ to $1\times10^{-3}$ mol, per mol of the silver halide.

The oxidation number of the gold sensitizers which are used when the silver halide emulsion according to the present invention is subjected to gold sensitization may be monovalent or trivalent and gold compounds usually used as gold sensitizers can be used. Representative examples thereof include, for example, chloroauric acid, potassium chloroaurate, auric trichloride, potassium auric thiocyanate, potassium iodoaurate, tetracyanoauric acid, ammonium aurothiocyanate, and pyridyl trichloro-gold The addition amount of the gold sensitizers varies according to various conditions but is preferably from $1\times10^{-7}$ mol, to $1\times10^{-3}$ mol, more preferably from $1\times10^{-6}$ mol $5\times10^{-4}$ mol, per mol of the silver halide as a criterion.

Various well-known selenium compounds can be used as a selenium sensitizer in the present invention. The selenium sensitization is usually carried out by adding labile and/or non-labile selenium compounds and stirring the emulsion at high temperature, preferably 40° C. or more, for a certain period of time. The compounds disclosed in JP-B-44-15748, JP-B-43-13489, JP-A-4-25832, JP-A-4-109240 and JP-A-4-324855 can be used as labile selenium compounds. The compounds represented by formulae (VIII) and (IX) disclosed in JP-A-4-324855 are particularly preferably used.

The tellurium sensitizer for use in the present invention is a compound which forms silver telluride on the surfaces or in the interiors of silver halide grains, which silver telluride is presumed to become sensitization speck. The formation rate of the silver telluride in the silver halide emulsion can be examined according to the method disclosed in JP-A-5-313284. The tellurium sensitizers which can be used in the present invention include, e.g., diacyltellurides, bis(oxycarbonyl)tellurides, bis(carbamoyl)tellurides, diacyltellurides, bis(oxycarbonyl)ditellurides, bis(carbamoyl)ditellurides, compounds having a P=Te bond, tellurocarboxylates, Te-organyltellurocarboxylates, di(poly)tellurides, tellurides, tellurols, telluroacetals, tellurosulfonates, compounds having a P-Te bond, Te-containing heterocyclic rings, tellurocarbonyl compounds, inorganic tellurium compounds, and colloidal tellurium. Specific examples of tellurium sensitizers which can be used in the present invention are those disclosed in the following patents and literature: U.S. Pat. Nos. 1,623,499, 3,320,069, 3,772,031, British Patents 235,211, 1,121,496, 1,295,462, 1,396,696, Canadian Patent 800,958, JP-A-4-204640, JP-A4-271341, JP-A-4-333043, JP-A-5303157, *J. Chem. Soc. Chem. Commun.*, 635 (1980), ibid., 1102 (1979), ibid., 645 (1979), *J. Chem. Soc. Perkin. Trans.* 1, 2191 (1980), S. Patai compiled, *The Chemistry of Organic Selenium and Tellurium Compounds*, Vol. 1 (1986), and ibid., Vol. 2 (1987). The compounds represented by formulae (II), (III) and (IV) disclosed in JP-A-5-313284 are particularly preferred.

The amount of the selenium and tellurium sensitizers to be used in the present invention varies according to the silver halide grains used and the conditions of chemical ripening, but is generally about $1\times10^{-8}$ to $1\times10^{-2}$ mol, preferably about $1\times10^{-7}$ to $1\times10^{-3}$ mol, per mol of the silver halide. There is no particular limitation on the conditions of chemical sensitization in the present invention, but pH is from 5 to 8, pAg is from 6 to 11, preferably from 7 to 10, and temperature is from 40 to 95° C., preferably from 45 to 85° C.

Cadmium salt, sulfite, lead salt and thallium salt may be coexist in the silver halide emulsion for use in the present invention in the process of the formation or physical ripening of silver halide grains.

Reduction sensitization can be used in the present invention. As specific compounds for use in reduction sensitization, for example, stannous chloride, aminoiminomethanesulfinic acid, hydrazine derivatives, borane compounds, silane compounds and polyamine compounds can be used in addition to ascorbic acid and thiourea dioxide. Reduction sensitization can be performed by carrying out ripening with maintaining the pH and pAg of the emulsion at 7 or more and 8.3 or less, respectively. Moreover, reduction sensitization can be effected by introducing a single addition area of silver ions during grain formation.

Thiosulfonic acid compounds may be added to the silver halide emulsion of the present invention according to the method disclosed in European Patent 293917.

The silver halide emulsion in the photothermographic material of the present invention may be one kind, or two or more kinds of silver halide emulsions (for example, those differing in average grain sizes, differing in halogen compositions, differing in crystal habits, or differing in the conditions of chemical sensitization) may be used in combination. Gradation can be controlled by using a plurality of photosensitive silver halides having different sensitivities. Techniques concerning these methods are disclosed in JP-A-57-119341, JP-A-53-106125, JP-A-47-3929, JP-A-48-55730, JP-A-46-5187, JP-A-50-73627, and JP-A-57-150841. It is preferred for each emulsion to have sensitivity difference of 0.2 logE or more.

The photosensitive silver halide according to the present invention is preferably used in an amount of from 0.03 to 0.6 $g/m^2$, more preferably from 0.05 to 0.4 $g/m^2$, and most preferably from 0.1 to 0.4 $g/m^2$, in silver amount per $m^2$ of the photothermographic material, and the use amount per mol of the organic silver salt is preferably from 0.01 to 0.5 mol, more preferably from 0.02 to 0.3 mol, and particularly preferably from 0.03 to 0.25 mol.

With respect to mixing methods and mixing conditions of photosensitive silver halide and organic silver salts prepared separately, there are a method of mixing photosensitive silver halide grains and organic silver salt having been prepared using a high speed stirrer, a ball mill, a sand mill, a colloid mill, a vibrating mill or a homogenizer, and a method of mixing photosensitive silver halide having been prepared at any time during preparation of organic silver salt to complete the production of organic silver salt. There is no restriction as to methods so long as the effect of the present invention can be sufficiently exhibited.

The preferred addition time of silver halide to the coating solution of image-forming layer is from 180 minutes before coating to immediately before coating, preferably from 60 minutes before to 10 seconds before coating. Mixing methods and mixing conditions are not particularly restricted so long as the effect of the present invention can be sufficiently exhibited. As specific mixing methods, a method of performing mixture in a tank in such a manner that the average residence time, which is calculated from the addition flow rate and the charging amount to the coater, coincides with the desired time, and a method of using a static mixer and the like as described in N. Harnby, M. F. Edwards, A. W. Nienow, translated by Koji Takahashi, *Liquid Mixing Techniques*, Chap. 8, published by Nikkan Kogyo Shinbunsha (1989) can be used.

In the present invention, when an organic silver salt-containing layer is formed by coating and drying a coating solution in which 30 wt % or more of the solvent is occupied by water, and further when a polymer latex which is soluble or dispersible in a water system solvent (water solvent) and, in particular, having an equilibrium moisture content at 25° C. 60% RH of which is 2 wt % or less is used as the binder of the organic silver salt-containing layer, the static electricity is relaxed. The most preferred polymer of the present invention is a polymer so prepared that ionic conductivity becomes 2.5 mS/cm or less. Such a polymer can be produced by a method of subjecting the polymer synthesized to purifying treatment using a separating function film.

"A water system solvent" in which the above polymer of the present invention is soluble or dispersible as used herein is water or water mixed with a water-miscible organic solvent in concentration of 70 wt % or less. As water-miscible organic solvents, alcohols such as methyl alcohol, ethyl alcohol, and propyl alcohol, cellosolves such as methyl cellosolve, ethyl cellosolve, and butyl cellosolve, ethyl acetate and dimethylformamide can be exemplified.

The system of a so-called dispersing state in which polymers are not dissolved thermodynamically is also called a water system solvent in the present invention.

"An equilibrium moisture content at 25° C. 60% RH" used in the present invention can be represented as follows with the weight of the polymer in humidity condition equilibrium at 25° C. 60% RH being W1 and the weight of the polymer at 25° C. dry state being W0:

An equilibrium moisture content at 25° C. 60% RH= $[(W1-W0)/W0]\times 100$ (wt %)

As for the definition and the measuring method of moisture content, e.g., *High Molecular Engineering, Lecture* 14, "Test Method of High Molecular Materials", compiled by Kobunshi-Gakkai, published by Chijin Shokan Co. Ltd. can be referred to.

The equilibrium moisture content at 25° C. 60% RH of the binder polymer according to the present invention is preferably 2 wt % or less, more preferably from 0.01 wt % to 1.5 wt %, and still more preferably from 0.02 wt % to 1 wt %.

Polymers which are dispersible in a water system solvent are particularly preferably used in the present invention.

As examples of dispersion conditions, there are latexes in which fine particles of solid polymers are dispersed and dispersions in which polymer molecules are dispersed in a molecular state or with forming micells, and any of these can be preferably used.

Hydrophobic polymers such as an acrylic resin, a polyester resin, a rubber-based resin (e.g., an SBR resin), a polyurethane resin, a vinyl chloride resin, a vinyl acetate resin, a vinylidene chloride resin, and a polyolefin resin can be preferably used in the present invention. Polymers may be straight chain, branched or crosslinked polymers. As polymers, any of homopolymers in which single monomers are polymerized and copolymers in which two or more monomers are copolymerized may be used. When copolymers are used, both of random copolymers and block copolymers may be used. The molecular weight of polymers is from 5,000 to 1,000,000, preferably from 10,000 to 200,000, in number average molecular weight. If the molecular weight is too small, the mechanical strength of the emulsion layer is insufficient, while when it is too large, the film property is disadvantageously deteriorated.

"Water system dispersion medium" described above means a dispersion system in which 30 wt % or more of the composition is occupied by water. As dispersion conditions, any of emulsified dispersion, micell dispersion, and dispersion in which polymers having hydrophilic parts in the molecule are dispersed in a molecular state can be used but latexes are particularly preferably used.

Specific examples of preferred polymer latexes are shown below. In the following, polymers are indicated as raw material monomers, the numerical values in parentheses are wt % and the molecular weights are number average molecular weights.

P-1: Latex comprising MMA (70)-EA (27)-MAA (3) (molecular weight: 37,000)

P-2: Latex comprising MMA (70)-2EHA (20)-St (5)-AA (5) (molecular weight: 40,000)

P-3: Latex comprising St (50)-Bu (47)-MAA (3) (molecular weight: 45,000)

P-4: Latex comprising St (68)-Bu (29)-AA (3) (molecular weight: 60,000)

P-5: Latex comprising St (70)-Bu (27)-IA (3) (molecular weight: 120,000)

P-6: Latex comprising St (75)-Bu (24)-AA (1) (molecular weight: 108,000)

P-7: Latex comprising St (60)-Bu (35)-DVB (3)-MAA (2) (molecular weight: 150,000)

P-8: Latex comprising St (70)-Bu (25)-DVB (2)-AA (3) (molecular weight: 280,000)

P-9: Latex comprising VC (50)-MMA (20)-EA (20)-AN (5)-AA (5) (molecular weight: 80,000)

P-10: Latex comprising VDC T85)-MMA (5)-EA (5)-MAA (5) (molecular weight: 67,000)

P-11: Latex comprising Et (90)-MAA (10) (molecular weight: 12,000)

P-12: Latex comprising St (70)-2EHA (27)-AA (3) (molecular weight: 130,000)

P-13: Latex comprising MMA (63)-EA (35)-AA (2) (molecular weight: 33,000)

Abbreviations of the above structures show the following monomers. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinvlbenzene, VC: vinyl chloride, AN: acrylonitrile, VDC: vinylidene chloride, Et: ethylene, and IA: itaconic acid.

The above-described polymers are commercially available and the following polymers can be used. As examples of acrylic resins, Sebian A-4635, 46583, and 4601 (manufactured by Daicel Chemical Industries Ltd.), Nipol Lx811, 814, 821, 820, and 857 (manufactured by Nippon Zeon Co., Ltd.), as examples of polyester resins, FINETEX ES650, 611, 675, and 850 (manufactured by Dainippon Chemicals and Ink Co., Ltd.), WD-size and WMS (manufactured by Eastman Chemical Co.), as examples of polyurethane resins, HYDRAN AP10, 20, 30, and 40 (manufactured by Dainippon Chemicals and Ink Co., Ltd.), as examples of rubber-based resins, LACSTAR 7310K, 3307B, 4700H, and 7132C (manufactured by Dainippon Chemicals and Ink Co., Ltd.), Nipol Lx416, 410, 438C, and2507 (manufactured by Nippon Zeon Co., Ltd.), as examples of vinyl chloride resins, G351 and G576 (manufactured by Nippon Zeon Co., Ltd.), as examples of vinylidene chloride resins, L502 and L513 (manufactured by Asahi Chemical Industry Co., Ltd.), and as examples of olefin resins, Chemipearl S120 and SA100 (manufactured by Mitsui Petrochemical Industries, Ltd.) can be exemplified.

These polymers latexes may be used alone or two or more of them may be blended, if necessary.

Styrene/butadiene copolymer latexes are particularly preferably used in the present invention. The weight ratio of the styrene monomer unit and the butadiene monomer unit in styrene/butadiene copolymers is preferably from 40/60 to 95/5. The ratio occupied by the styrene monomer unit and the butadiene monomer unit in the copolymer is preferably from 60 to 99 wt %. The preferred molecular weight is the same as described above.

Preferred styrene/butadiene copolymer latexes which can be used in the present invention are the foregoing P-3 and P-8 and commercially available products LACSTAR-3307B, 7132C, and Nipol Lx416.

Hydrophilic polymers such as gelatin, polyvinyl alcohol, methyl cellulose, and hydroxypropyl cellulose may be added to the organic silver salt-containing layer of the photothermographic material of the present invention, according to necessity. The addition amount of these hydrophilic polymers is preferably 30 wt % or less, more preferably 20 wt % or less, based on the total amount of the binder of the organic silver salt-containing layer.

The organic silver salt-containing layer (i.e., an image-forming layer) according to the present invention is formed of polymer latexes. The weight ratio of the total binder/the organic silver salt in the organic silver salt-containing layer is preferably from 1/10 to 10/1, more preferably from 1/5 to 4/1.

Such an organic silver salt-containing layer is, in general, also a photosensitive layer (an emulsion layer) containing photosensitive silver halide as a photosensitive silver salt. In this case, the weight ratio of the total binder/silver halide is preferably from 400 to 5, more preferably from 200 to 10.

The total binder amount in the image-forming layer of the present invention is preferably from 0.2 to 30 g/m$^2$, more preferably from 1 to 15 g/m$^2$. The image-forming layer of the present invention may contain a crosslinking agent for cross-linking and a surfactant for improving coating property.

The solvent for the coating solution of the organic silver salt-containing layer of the photothermographic material of the present invention (solvent and dispersion medium are briefly expressed solvent collectively) is a water system solvent containing 30 wt % or more of water. As components other than water, water-miscible organic solvents such as methyl alcohol, ethyl alcohol, isopropyl alcohol, methyl cellosolve, ethyl cellosolve, dimethylformamide and ethyl acetate may be arbitrarily used in the coating solution. The water content in the solvent of the coating solution is preferably 50 wt % or more, more preferably 70 wt % or more. Preferred examples of the composition of the solvent include, in addition to water, water/methyl alcohol 90/10 (wt %), water/methyl alcohol=70/30, water/methyl alcohol/dimethylformamide=80/15/5, water/methyl alcohol/ethyl cellosolve=85/10/5, water/methyl alcohol/isopropyl alcohol=85/10/5, etc.

Sensitizing dyes for use in the present invention are not restricted so long as they can spectrally sensitize silver halide grains in a desired wavelength region when they adsorbed onto silver halide grains. Sensitizing dyes such as a cyanine dye, a merocyanine dye, a complex cyanine dye, a complex merocyanine dye, a holopolar cyanine dye, a styryl dye, a hemicyanine dye, an oxonol dye and a hemioxonol dye can be used. Useful sensitizing dyes which can be used in the present invention are described, for example, in *Research Disclosure*, Vol. 17643, Item IV-A, p. 23 (December, 1978), ibid., Vol. 1831, Item X, p. 437 (August, 1979) or the literature cited therein. In particular, sensitizing dyes having spectral sensitivity suitable for spectral characteristics of light sources of various laser imagers, scanners, image setters, and process cameras (i.e., plate-making camera) can be advantageously selected.

Sensitizing dyes are disclosed in JP-A-10-62899, paragraphs 0056to0066, JP-A-10-186572 (the compound represented by formula (II)), and EP-A-0803764, line 38, page 19 to line 35, page 20. The sensitizing dyes preferably used in the present invention include dyes having a carboxylic acid group (e.g., dyes disclosed in JP-A-3-163440, JP-A-6-301141, U.S. Pat. No. 5,441,899), merocyanine dyes, polynuclear merocyanine dyes, polynuclear cyanine dyes (e.g., dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, Japanese Published Unexamined International Application No. 5-550111, British Patent 1,467,638, U.S. Pat. No. 5,281,515), and dyes forming J-band (U.S. Pat. Nos. 5,510,236, 3,871,887 (dyes in Example 5), JP-A-2-96131 and JP-A-59-48753).

These sensitizing dyes may be used alone or in combination of two or more. A combination of sensitizing dyes is often used for the purpose of supersensitization. Dyes which themselves do not have a spectral sensitizing function or substances which substantially do not absorb visible light but show supersensitization can be incorporated into an emulsion with sensitizing dyes. Useful sensitizing dyes, combinations of dyes which show supersensitization, substances which show supersensitization are described in *Research Disclosure*, Vol. 176, No. 17643, Item IV-J, p. 23 (December, 1978), and JP-B-49-25500, JP-B-43-4933, JP-A-59-19032 and JP-A-59-192242.

For the inclusion of sensitizing dyes in a silver halide emulsion, they may be directly dispersed in an emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., and then added to an emulsion.

In addition, various methods can be used for the addition of sensitizing dyes to an emulsion, for example, a method in which sensitizing dyes are dissolved in a volatile organic solvent, the solution is dispersed in water or hydrophilic colloid and this dispersion is added to an emulsion as disclosed in U.S. Pat. No. 3,469,987, a method in which sensitizing dyes are dissolved in an acid and the solution is added to an emulsion, or sensitizing dyes are added to an emulsion as an aqueous solution coexisting with an acid or a base as disclosed in JP-B-44-23389, JP-B-44-27555 and JP-B-57-22091, a method in which dyes are added to an emulsion as an aqueous solution or a colloidal dispersion coexisting with a surfactant as disclosed in U.S. Pat. Nos. 3,822,135 and 4,006,025, a method in which dyes are directly dispersed in a hydrophilic colloid and the dispersion is added to an emulsionas disclosed in JP-A-53-102733and JP-A-58-105141, or a method in which dyes are dissolved using a compound capable of red-shifting and the solution is added to an emulsion as disclosed in JP-A-51-74624 can be used. Further, ultrasonic waves can be used for dissolution.

The time of the addition of the sensitizing dyes for use in the present invention to the silver halide emulsion of the present invention may be at any stage of the preparation of the emulsion reconized as useful hitherto For example, they may be added at any stage if it is before coating, i.e., before grain formation stage of silver halide grains or/and before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Also, as disclosed in U S. Pat. No. 4,225,666 and JP-A-58-7629, the sensitizing dyes can be used as a single compound alone or in combination with compounds having foreign structures, and they can be divided and added separately, for example, one part of them is added during grain formation stage and the remaining is added during chemical ripening or after the completion of chemical ripening, otherwise one part is added prior to chemical ripening or during ripening stage and the remaining after completion of chemical ripening. The kinds of compounds added separately and combinations of compounds maybe varied. The preferred addition time is after desalting and before coating, and more preferred time is after desalting and before beginning of chemical ripening.

The use amount of the sensitizing dyes according to the present invention may be selected according to properties such as sensitivity and fog, but is preferably from $10^{-6}$to 1 mol, more preferably from $10^{-4}$ to $10^{-1}$ mol, per mol of the silver halide in the photosensitive layer.

The addition of antifoggants, stabilizers and stabilizer precursors to the silver halide emulsion or/and the organic silver salt according to the present invention prevents additional fog from occurring and the stability of sensitivity during storage from lowering. Appropriate antifoggants, stabilizers and stabilizer precursors which can be used alone or in combination are disclosed in JP-A-10-62899, paragraph 0070, and EP-A-0803764, line 57, page 20 to line 7, page 21.

Antifoggants which are preferably used in the present invention are organic halides and those compounds disclosed in the following patents can be exemplified: JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, JP-A-10-339934, U.S. Pat. Nos. 5,340,712, 5,369,000 and 5,464,737. In particular, the compounds represented by formula (II) in JP-A-10-339934 (specifically, tribromomethylnaphthylsulfone, tribromomethylphenylsulfone, tribromomethyl[4-(2,4,6-trimethylphenylsulfonyl)phenyl]sulfone, etc.) are preferably used.

Antifoggants for use in the present invention may be added in the form of, e.g., a solution, a powder, or a solid fine particle dispersion. Solid fine particle dispersion is performed with well-known atomizing means, e.g., a ball mill, a vibrating ball mill, a sand mill, a colloid mill, a jet mill, a roller mill, etc. Auxiliary dispersants such as anionic surfactants, e.g., sodium triisopropylnaphthalenesulfonate (a mixture of three compounds respectively having different substitution position of isopropyl group), may be used for solid fine particle dispersion.

Although it is not necessary for the execution of the present invention, the addition of mercury(II) salts to an emulsion layer as an antifoggant sometimes brings about advantageous results. Preferred mercury(II) salts for this purpose are mercury acetate and mercury bromide. The amount of mercury used in the present invention is preferably from $1\times10^{-9}$ mol to $1\times10^{-3}$ mol, more preferably from $1\times10^{-9}$ mol to $1\times10^{-4}$ mol, per mol of the silver coated.

The photothermographic material according to the present invention may contain azolium salts and benzoic acids for the purpose of increasing sensitivity and preventing fog. As azolium salts which can be used in the present invention, the compounds represented by formula (XI) in JP-A-59-193447, the compounds disclosed in JP-B-55-12581, and the compounds represented by formula (II) in JP-A-60-153039 can be exemplified. Benzoic acids which can be used in the present invention may be any benzoic acid derivatives. The compounds disclosed in U.S. Pat. Nos. 4,784,939, 4,152,160, JP-9-329865, JP-9-329864 and JP-A-9-281637 can be exemplified as examples having preferred structures. Azolium salts and benzoic acids of the present invention can be added to anywhere of the photothermographic material, preferably added to the layers of the side on which a photosensitive layer is provided, more preferably added to the organic silver salt-containing layer. The time of the addition of azolium salts and benzoic acids for use in the present invention may be at any stage of the preparation of the coating solution. When they are added to the organic silver salt-containing layer, they may be added at any stage from the forming stage of the organic silver salt to the forming stage of the coating solution, but preferably they are added to the coating solution after preparation of the organic silver salt and immediately before coating. Azolium salts and benzoic acids for use in the present invention may be added in the form of, e.g., a powder, a solution, or a solid fine particle dispersion. They may be added as the mixed solution with other additives such as sensitizing dyes, reducing agents and toners. The addition amount of azolium salts and benzoic acids may be any amount, preferably from $1\times10^{-6}$ to 2 mol, more preferably from $1\times10^{-3}$ to 0.5 mol, per mol of the silver.

The photothermographic material of the present invention can contain a mercapto compound, a disulfide compound and a thione compound for the purpose of controlling or accelerating development, improving spectral sensitization efficiency and improving storage stability before and after development.

A mercapto compound, a disulfide compound and a thione compound are disclosed in JP-A-10-62899 (paragraphs 0067 to 0069) JP-A-10-186572 (the compound represented by formula (I), and specific examples thereof are described in paragraphs 0033 to 0052), and EP-A-0803764, lines 36 to 56 on page 20. Mercapto-substituted heterocyclic aromatic compounds are particularly preferred and 2-mercaptobenzimidazole, 2-mercapto-5-methylbenzimidazole, 2-mercaptobenzoxazole, 2-mercaptobenzothiazole, 6-ethoxy-2-mercaptobenzothiazole, 2,2'-dithiobis-(benzothiazole), 3-mercapto-1,2,4-triazole, 4,5-diphenyl-2-imidazole thiol, 2-mercaptoimidazole, 1-ethyl- 2-mercaptobenzimidazole, 2-mercaptoquinoline, 8-mercaptopurine, 2-mercapto-4(3H)-quinazolinone, 7-trifluoromethyl-4-quinoline thiol, 2,3,5,6-tetrachloro-4-pyridine thiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole, and 3-mercapto-4-phenyl-5-heptyl-1,2,4-triazole can be exemplified.

Mercapto compounds are preferably added in an amount of from 0.001 to 1.0 mol, more preferably from 0.01 to 0.3 mol, per mol of the silver in the emulsion layer.

When "a toner", which is known as an additive for improving images, is used, optical density sometimes increases, and it is preferably used in the present invention. A toner contributes to, in some cases, black tone silver image formation. A toner is preferably added to the side on which an image-forming layer is provided in an amount of from 0.1 to 50 mol %, more preferably from 0.5 to 20 mol %, per mol of the silver. A toner may be a so-called precursor which has been derived to have a function effectively only at the time of development.

These toners as disclosed in JP-A-10-62899, paragraphs 0054 to 0055, and EP-A-0803764, lines 23 to 48 on page 21, and phthalazinone, phthalazinone derivatives or metal salts thereof, or derivatives such as 4-(1-naphthyl)phthalazinone, 6-chlorophthalazinone, 5,7-dimethoxyphthalazinone, and 2,3-dihydro-1,4-phthalazinedione; combinations of phthalazinone and phthalic acid derivatives (e.g., phthalic acid, 4-methylphthalic acid, 4-nitrophthalic acid, and tetrachlorophthalic anhydride); phthalazines (e.g., phthalazine, phthalazine derivatives or metal salts thereof, or derivatives such as 4-(1-naphthyl)-phthalazine, 6-isopropylphthalazine, 6-t-butylphthalazine, 6-chlorophthalazine, 5,7-dimethoxyphthalazine, and 2,3-dihydro-phthalazine); and combinations of phthalazines and phthalic acid derivatives (e.g., phthalic acid, 4-methylphthalic acid, 4-nitrophthalic acid, and tetrachlorophthalic anhydride) are preferably used, and combinations of phthalazines and phthalic acid derivatives are particularly preferably used.

Toners for use in the present invention may be added in the form of, e.g., a solution, a powder, or a solid fine particle dispersion. Solid fine particle dispersion is performed using well-known atomizing means, e.g., a ball mill, a vibrating ball mill, a sand mill, a colloid mill, a jet mill, a roller mill, etc. Auxiliary dispersants may be used for solid fine particle dispersion.

The image-forming layer (preferably a photosensitive layer) of the present invention can contain, as a plasticizer and a lubricant, polyhydric alcohols (e.g., glycerins and diols disclosed in U.S. Pat. No. 2,960,404), fatty acids or fatty acid esters disclosed in U.S. Pat. Nos. 2,588,765 and 3,121,060, and silicone resins disclosed in British Patent 955,061.

A super-high contrast agent (i.e., a super contrast increasing agent) can be used in the present invention to form a super-high contrast image. For example, hydrazine derivatives disclosed in U.S. Pat. Nos. 5,464,738, 5,496,695, 6,512,411, 5,536,622, JP-A-10-10672, JP-A-10-10672, JP-10-62898, JP-A-10-31282, JP-A-9-319048, JP-A-9-304870 and JP-A-9-304872, the compounds having a quaternary nitrogen atom disclosed in JP-A-9-274274, and the acrylonitrile compounds disclosed in U.S. Pat. No. 5,545,515 can be used as a super-high contrast agent. As specific examples of the compounds, Compounds 1 to 10 disclosed in U.S. Pat. Nos. 5,464,738, Compounds H-1 to H-28 in U.S. Pat. No. 5,496,695, Compounds I-1 to I-86 in JP-A-10-10672, Compounds H-1 to H-26 in JP-A-10-62898, Compounds 1-1 to 1-21 in JP-A-10-31282, Compounds 1 to 50 in JP-A-9-304870, Compounds 1 to 40 in JP-A-9-304872, Compounds P-1 to P-26, and T-1 to T-18 in JP-A-9-274274, and Compounds CN-1 to CN-13 in U.S. Pat. No. 5,545,515 can be exemplified.

For forming a super-high contrast image, high contrast accelerators can be used in the present invention in combination with the above-described super-high contrast agents. For example, amine compounds disclosed in U.S. Pat. No. 5,545,505, specifically Compounds AM-1 to AM-5; hydroxamic acids disclosed in U.S. Pat. No. 5,545,507, specifically HA-1 to HA-11; acrylonitriles disclosed in U.S. Pat. No. 5,545,507, specifically CN-1 to CN-13; hydrazine compounds disclosed in U.S. Patent 5,558,983, specifically CA-1 to CA-6; and onium salts disclosed in JP-A-9-297368, specifically A-1 to A-42, B-1 to B-27, and C-1 to C-14 can be used.

Synthesizing methods, addition methods, and addition amounts of each of the foregoing super-high contrast agents and high contrast accelerators (i.e., contrast increasing accelerators) are described in the above-cited respective patents.

The photothermographic material according to the present invention can be provided with a surface protective layer for the purpose of preventing adhesion.

Any polymer can be used as the binder of the surface protective layer of the present invention. It is preferred, however, to contain polymers having a carboxylic acid residue in an amount of from 100 mg/m$^2$ to 5 g/m$^2$. Examples of the polymers having a carboxylic acid residue used herein include natural polymers (e.g., gelatin, alginic acid), modified natural polymers (e.g., carboxymethyl cellulose, phthalated gelatin), and synthetic polymers (e.g., polymethacrylate, polyacrylate, a polyalkyl methacrylate/acrylate copolymer, a polystyrene/polymethacrylate copolymer). The content of such a carboxylic acid residue of polymer is preferably from $1\times10^{-2}$ to 1.4 mol per 100 g of the polymer. Further, the carboxylic acid residue may form a salt with an alkali metal ion, an alkaline earth metal ion or an organic cation.

It is also preferred to use polyvinyl alcohol (PVA) in the surface protective layer of the photothermographic material according to the present invention and, for example, as a completely saponified product, PVA-105 [polyvinyl alcohol (PVA) content: 94.0 wt % or more, saponification degree: 98.5±0.5mol %, sodium acetate content: 1.5 wt % or less, volatile content: 5.0 wt % or less, viscosity (4 wt %, 20° C.): 5.6±0.4 CPS], as a partially saponified product, PVA-205 [PVA content: 94.0 wt %, saponification degree: 88.0±1.5 mol %, sodium acetate content: 1.0 wt %, volatile content: 5.0 wt %, viscosity (4 wt %, 20° C,): 5.0±0.4 CPS], and modified polyvinyl alcohol MP-102, MP-202, MP-203, R-1130, and R-2105 (manufactured by Kuraray Co., Ltd.) can be exemplified.

The coating amount of polyvinyl alcohol of the protective layer (per one layer) is preferably from 0.3 to 4.0 g/m$^2$, more preferably from 0.3 to 2.0 g/m$^2$, per m$^2$ of the support.

Any adhesion preventing material may be used in the surface protective layer according to the present invention. Examples of adhesion preventing materials include waxes, silica particles, styrene-containing elastomeric block copolymers (e.g., styrene-butadiene-styrene, styrene-isoprene-styrene), cellulose acetate, cellulose acetate butyrate, cellulose propionate, and mixtures of these. Further, the surface protective layer may contain a crosslinking agent for crosslinking and a surfactant for improving a coating property.

The image-forming layer or the protective layer of the image-forming layer according to the present invention can contain light absorbing substances or filter dyes as disclosed in U.S. Pat. Nos. 3,253,921, 2,274,782, 2,527,583 and 2,956,879. Further, dyes can be mordanted as disclosed in U.S. Patent 3,282,699. With respect to the use amount of filter dyes, the absorbance at exposure wavelength is preferably from 0.2 to 3.0, particularly preferably from 0.2 to 1.5.

The image-forming layer or the protective layer of the image-forming layer according to the present invention can contain a matting agent, e.g., starch, titanium dioxide, zinc oxide, silica, or polymer beads containing beads disclosed in U.S. Pat. Nos. 2,992,101 and 2,701,245.

The coating solution of the image-forming layer of the present invention is preferably prepared at temperature of from 30° C. to 65° C., more preferably 35° C. or higher and lower than 60° C., and still more preferably from 35° C. to 55° C. Further, the temperature of the image-forming layer-coating solution immediately after the addition of a polymer latex is preferably maintained-at from 30° C. to 65° C. A reducing agent and an organic silver salt have been preferably mixed before the addition of a polymer latex.

The liquid containing the organic silver salt or the coating solution of the photothermographic image-forming layer according to the present invention is preferably a so-called thixotropic liquid. Thixotropy is the property which lowers in viscosity as the shear rate increases. Any test apparatus can be used in the viscosity measurement in the present invention. RFS Fluid Spectrometer manufactured by Rheometrics Far East Co. is preferably used. Measurement is performed at 25° C. The viscosity at the shear rate of 0.1 $S^{-1}$ of the liquid containing the organic silver salt or the coating solution of the photothermographic image-forming layer according to the present invention is preferably from 400 mPa·s to 100,000 mPa·s, more preferably from 500 mPa·s to 20,000 mPa·s. The viscosity at shear rate of 1,000 $S^{-1}$ is preferably from 1 mPa·s to 200 mPa·s, more preferably from 5 mPa·s to 80 mPa·s.

Various systems exhibiting thixotropy are known and described, for example, in *Lecture, Rheology*, Muroi, Morino, *High Molecular Latexes*, compiled by Kobunshi Kanko Kai, published by Kobunshi Kanko Kai. It is necessary for liquid to contain a large amount of solid fine particles to exhibit thixotropy. For heightening thixotropy, viscosity-increasing linear high molecules must be contained. Further, it is effective that solid fine particles contained have a large aspect ratio anisotropically, in addition, the use of alkali thickeners and surfactants is also effective.

The emulsion for the photothermographic material according to the present invention comprises one or more layers on a support. One layer constitution must contain an organic silver salt, a silver halide, a developer, and a binder, in addition to these, desired additional materials, e.g., a toner, a covering aid, and other auxiliary agents. Two layer constitution must contain an organic silver salt and a silver halide in the first emulsion layer (generally the layer adjacent to the support), and other several components in the second emulsion layer, or in both the first and second layers. There is another two layer constitution comprising a single emulsion layer containing all the components and a protective top coating layer, however. In the constitution of a multi-color photothermographic material, each color may comprise a combination of these two layers. Alternatively, as disclosed in U.S. Pat. No. 4,708,928, a single layer may contain all the components. In the case of a multi-dye multi-color photosensitive photothermographic material, in general, a functional or non-functional barrier layer is provided between each emulsion layer (a photosensitive layer) to separate and retain each emulsion layer as disclosed in U.S. Pat. No. 4,460,681.

Various kinds of dyes and pigments can be used in the photosensitive layer of the present invention with a view to improving tone, preventing generation of interference fringe, preventing irradiation, and improving the unevenness at laser exposure, which are disclosed in detail in WO 98/36322. As preferred dyes and pigments for use in the photosensitive layer according to the present invention, anthraquinone dyes, azomethine dyes, indoaniline dyes, azo dyes, anthraquinone-based indanthrone pigments (e.g., C.I. Pigment Blue 60), phthalocyanine pigments (e.g., copper phthalocyanine such as C.I. Pigment Blue 15, nonmetal phthalocyanine such as C.I. Pigment Blue 16), dyeing lake pigment-based triarylcarbonyl pigments, indigo, and inorganic pigments (e.g., ultramarine blue, cobalt blue). These dyes and pigments may be added in the form of, e.g., a solution, an emulsion, a solid fine particle dispersion, or in the state mordanted by a high molecular mordant. The amount of these compounds is determined by the desired absorbing amount but, in general, from 1 $\mu$g to 1 g per $m^2$ of the photographic material is preferred.

A backside resistive heating layer disclosed in U.S. Pat. Nos. 4,460,681 and 4,374,921 can also be used in the photothermographic material in the present invention.

The single side photothermographic material according to the present invention may contain matting agents for improving transporting property. Matting agents in general comprise fine particles of water-insoluble organic or inorganic compounds. Optional matting agents can be used in the present invention. Organic matting agents disclosed in U.S. Pat. Nos. 1,939,213, 2,701,245, 2,322,037, 3,262,782, 3,539,344, and 3,767,448, and inorganic matting agents disclosed in U.S. Pat. Nos. 1,260,772, 2,192,241, 3,257,206, 3,370,951, 3,523,022 and 3,769,020 are well-known in this industry and can be used in the present invention. As specific examples of organic compounds which can be used as matting agents, examples of water-dispersible vinyl polymers include polymethyl acrylate, polymethyl methacrylate, polyacrylonitrile, acrylonitrile-$\alpha$-methylstyrene copolymers, polystyrene, styrene/divinylbenzene copolymers, polyvinyl acetate, polyethylene carbonate, polytetrafluoroethylene, etc., examples of cellulose derivatives include methyl cellulose, cellulose acetate, cellulose acetate propionate, etc., examples of starch derivatives include carboxyl starch, carboxynitrophenyl starch, urea/formaldehyde/starch reaction products, etc., hardened gelatin treated with well-known hardening agents and hardened gelatin as microencapsulated hollow product by coacervation hardening can be preferably used. As examples of inorganic compounds, silicon dioxide, titanium dioxide, magnesium dioxide, aluminum oxide, barium sulfate, calcium carbonate, silver chloride and silver bromide desensitized by well-known methods, glass, and diatomaceous earth can be preferably used. These matting agents can be mixed with different kinds of substances, if necessary. The size and shape of the matting agent are not particularly limited and optional diameters can be selected. In the present invention, matting agents of the average particle size of preferably from 0.1 $\mu$m to 30 $\mu$m, more preferably from 2 $\mu$m to 10 $\mu$m, can be used. The particle size distribution of the matting agent may be broad or narrow On the other hand, as matting agents largely affect the haze of the photothermographic material and the surface gloss, it is desired to adjust particle size, particle shape and particle size distribution to a necessary condition when matting agents are prepared or by mixing a plurality of matting agents. When a plurality of matting agents are mixed, the largest average particle size is preferably from 2 $\mu$m to 10 $\mu$m . The particle size is calculated in terms of a sphere.

The coating amount of the matting agent is from 1 to 400 mg/$m^2$, more preferably from 5 to 300 mg/$m^2$ of the photothermographic material.

The matting degree of the emulsion surface is not particularly limited so long as white-spot unevenness does not occur, but Bekk's smoothness is preferably from 50 to 10,000 seconds, particularly preferably from 80 to 10,000 seconds.

The matting degree of the backing layer according to the present invention is preferably Bekk's smoothness of from 1,200 seconds to 10 seconds, more preferably from 700 seconds to 30 seconds, and still more preferably from 500 seconds to 50 seconds.

In the present invention, matting agents are preferably added to the outermost surface layer, the layer which functions as the outermost surface layer, or the layer near the outer surface. They are also preferably added to the layer functioning as a protective layer.

Hardening agents may be used in each of the image-forming layer (preferably photosensitive layer), protective layer, and backing layer. Examples of hardening agents are described in T. H. James, *The Theory of the Photographic Process*, the 4th Ed , pp. 77 to 87, Macmillan Publishing Co., Inc. (1977), and polyvalent metal ions described on p. 78 of the above literature, polyisocyanates disclosed in U.S. Pat. No. 4,281,060 and JP-A-6-208193, epoxy compounds disclosed in U.S. Pat. No. 4,791,042, and vinyl sulfone compounds disclosed in JP-A-62-89048 are preferably used in the present invention.

Hardening agents are added as a solution. The preferred addition time of the solution to the protective layer coating solution is from 180 minutes before coating to immediately before coating, preferably from 60 minutes before to 10 seconds before coating. Mixing methods and mixing conditions are not particularly restricted so long as the effect of the present invention can be sufficiently exhibited. As specific mixing methods, a method of performing mixture in a tank in such a manner that the average residence time, which is calculated from the addition flow rate and the charging amount to the coater, coincides with the desired time, and a method of using a static mixer and the like as described in N. Harnby, M. F. Edwards, A. W. Nienow, translated by Koji Takahashi, *Liquid Mixing Techniques*, Chap. 8, published by Nikkan Kogyo Shinbun-sha (1989) can be used.

Surfactants may be used in the present invention for the purpose of improving coating property and electrostatic charge. Any surfactant can be used arbitrarily, e.g., nonionic, anionic, cationic and fluorine-based surfactants. Specifically, fluorine-based high molecular surfactants disclosed in JP-A-62-170950 and U.S. Pat. No. 5,380,644, fluorine-based surfactants disclosed in JP-A-60-244945 and JP-A-63-188135, polysiloxane-based surfactants disclosed in U.S. Pat. No. 3,885,965, and polyalkylene oxide and anionic surfactants disclosed in JP-A-6-301140 can be exemplified.

Examples of the solvents for use in the present invention are described in, e.g., *New Edition, Solvent Pocketbook*, Ohm Publishing Co. (1994), but the present invention is not limited thereto. The solvents for use in the present invention preferably have a boiling point of from 40° C. to 180° C.

Examples of the solvents for use in the present invention include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, and water.

The photographic emulsion for a photothermographic material according to the present invention can be coated on various supports. Representative examples of the supports include polyester films, undercoated polyester films, poly(ethylene terephthalate) films, polyethylene naphthalate films, cellulose nitrate films, cellulose ester films, poly(vinyl acetal) films, polycarbonate films, and related or resinous materials, glass, paper, and metal. Flexible substrates, in particular, paper supports coated with baryta and/or partially acetylated α-olefin polymers, in particular, α-olefin polymers having from 2 to 10 carbon atoms such as polyethylene, polypropylene, ethylene/butene copolymer are representatively used in the present invention. Supports may be transparent or translucent but are preferably transparent. A transparent support may be colored with a bluing dye (e.g., Dye 1 disclosed in the Example of JP-A-8-240877).

The photothermographic material according to the present invention is preferably a mono-sheet type material (a type capable of forming an image on the photothermographic material not using other sheet, e.g., an image-receiving material).

The photothermographic material according to the present invention may further contain an antioxidant, a stabilizer, a plasticizer, an ultraviolet absorber, or a coating aid. Various additives are added to either a photosensitive layer such as an image-forming layer or a photo-insensitive layer. With respect to the addition of these additives, WO 98/36322, EP-A-803764, JP-A-10-186567 and JP-A-10-18568 can be referred to.

The image-forming layer (preferably a photosensitive layer) of the present invention can contain, as a plasticizer and a lubricant, polyhydric alcohols (e.g., glycerins and diols of the kinds as disclosed in U.S. Pat. No. 2,960,404), fatty acids or fatty acid esters disclosed in U.S. Pat. Nos. 2,588,765 and 3,121,060, and silicone resins disclosed in British Patent 955,061.

The method for obtaining color images with the photothermographic material according to the present invention is disclosed in JP-A-7-13295, from line 43, left column, p. 10, to line 40, left column, p. 11. Further, color image stabilzers are disclosed in British Patent 1,326,889, U.S. Pat. Nos. 3,432,300, 3,698,909, 3,574,627, 3,573,050, 3,764,337 and 4,042,394.

The photothermographic material according to the present invention may be coated by any method. Specifically, extrusion coating, slide coating, curtain coating, immersion coating, knife coating, flow coating, and various coating methods including extrusion coating using hoppers disclosed in U.S. Pat. No. 2,681,294 can be used. Extrusion coating and slide coating described in Stephen F. Kistler, Peter M. Schweizer, *Liquid Film Coating*, pp. 399 to 536, Chapman & Hall Co. (1997) are preferably used, and slide coating is particularly preferably used. Examples of the shapes of slide coaters for use in slide coating are described in ibid., p. 427, FIG. 11b.1. Two or more layers can be simultaneously coated by the methods described in ibid., pp. 399 to 536, U.S. Pat. No. 2,761,791 and British Patent 837,095, if desired.

The photothermographic material according to the present invention can include other additional layers, e.g., a dye-receiving layer for receiving transfer dye images, an opaque layer for the time when reflective printing is desired, a protective top coating layer, and a primer layer which is known in light/heat photographic techniques. The photothermographic material according to the present invention is preferred in that image formation is feasible with that one sheet only and a functional layer such as an image-receiving layer which is necessary for image formation requires no different material.

With respect to the photothermographic material according to the present invention, the following patents can also be referred to: EP-A-803764, EP-A-883022, WO 98/36322, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569, JP-A-10-186570, JP-A-10-186571, JP-A-10-186572, JP-A-10-197974, JP-A-10-197982, JP-A-10-197983, JP-A-10-197985, JP-A-10-197986, JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, and JP-A-11-30832.

The photothermographic material according to the present invention can be developed by any method. However, in general, the imagewise exposed photothermographic material is developed with increasing the temperature. The developing temperature is preferably from 80 to 250° C., more preferably from 100 to 140° C., and the developing time is preferably from 1 to 180 seconds, more preferably from 10 to 90 seconds, and particularly preferably from 10 to 40 seconds.

A plate heater system is preferably used as the thermal developing method. Plate heater systems disclosed in JP-A-11-133572 are preferably used in the present invention, which are methods using a heat developing apparatus to obtain a visible image by making a photothermographic material, in which a latent image has been formed, contact with a heating means at a heat development area. The foregoing heating means comprises a plate heater, and a plurality of pressing rollers arranged along one surface of the plate heater vis-a-vis with the plate heater. Heat development is performed by passing the foregoing photothermographic material between the above pressing rollers and the plate heater. It is preferred to divide the plate heater to two to six stages and make the temperature of the tip part of the heater low by 1 to 10° C. or so. Such a method is disclosed in JP-A-54-30032, which method is capable of removing the moisture content and the organic solvent contained out of the material, and inhibiting the deformation of the support due to sudden heating of the photothermographic material.

The photothermographic material according to the present invention may be exposed according to any method, but laser beams are preferably used as a light source. A gas laser ($Ar^+$, He– Ne), a YAG laser, a dye laser and a semiconductor laser are preferably used as exposure light sources in the present invention. A semiconductor laser and second harmonic generating element can also be used. Red-infrared emission gas and a semiconductor laser are preferably used.

A single mode laser can be utilized in the present invention, but the photothermographic material according to the present invention shows low haze by exposure and interference fringe is liable to be generated. A method of making laser beams come in obliquely to the photothermographic material as disclosed in JP-A-5-113548 and a method of using a multi-mode laser as disclosed in WO 95/31754 are known techniques to prevent generation of interference fringe. These techniques are preferably used in the present invention.

For exposing the photothermographic material according to the present invention, it is preferred to perform exposure in such a manner that laser beams are overlapped so as to hide scanning lines as disclosed in *SPIE*, Vol. 169, "Laser Printing", pp. 116 to 128 (1979), JP-A-4-51043 and WO 95/31754.

Laser output is preferably 1 mW or more, more preferably 10 mW or more, and still more preferably high output of 40 mW or more. At that time, a plurality of lasers may be gathered together. The diameter of the laser beam can be made about 30 to 200 $\mu$m by Gaussian beam spot size of $1/e^2$.

It is preferred that the photothermographic material of the present invention be used, by forming a black-and-white image by a silver image, as a photothermographic material for medical diagnosis, a photothermographic material for industrial photography, a photothermographic material for printing, and a photothermographic material for COM. When the photothermographic material is used in these uses, it is a matter of course that a duplicated image can be made with duplication film MI-Dup (manufactured by Fuji Photo Film Co., Ltd.) from the black-and-white image formed for medical diagnosis, and as the printing use, the photothermographic material can be used as a mask for forming image on- dot-to-dot work films DO-175, PDO-100 (manufactured by Fuji Photo Film Co , Ltd.) and an offset printing plate.

EXAMPLE

The present invention is described in detail with reference to the examples, but it should not be construed as being limited thereto.

Example I

Preparation of PET Support

PET having an intrinsic viscosity IV=0.66 (measured in phenol/tetrachloroethane (6/4 by weight) at 25° C.) was obtained according to ordinary method with terephthalic acid and ethylene glycol. After the obtained PET was pelletized and dried at 130° C. for 4 hours, melted at 300° C., extruded from T-die, and quenched, thereby an uns retched film having a film thickness after thermal fixation of 175 $\mu$m was obtained.

The film was stretched to 3.3 times in the machine direction with rollers having different peripheral speeds, then 4.5 times in the transverse direction by means of a tenter. The temperatures at that time were 110° C. and 130° C. respectively. Subsequently, the film was subjected to thermal fixation at 240° C. for 20 seconds, then relaxation by 4% in the transverse direction at the same temperature. The chuck part of the tenter was then slit, and both edges of the film were subjected to knurl treatment. The film was rolled at 4 kg/cm$^2$, thereby a roll of film having a thickness of 175 $\mu$m was obtained.

Corona Discharge Treatment of Support Surface

Both surfaces of the support were put under room temperature and corona discharge treatment was performed at 20 m/min with a solid state corona treating apparatus model 6 KVA manufactured by Piller Co. From the reading of electric current and voltage, treatment applied to the support at that time was revealed to be 0.375 kV·A·min/m$^2$. The frequency at treatment at that time was 9.6 kHz and the gap clearance between the electrode and the dielectric roll was 1.6 mm.

Preparation of Undercoated Support

| (1) Preparation of Coating Solution for Undercoat Layer Prescription (1) (undercoat layer on the photosensitive layer side) | |
|---|---|
| Pesresin A-515GB (30 wt % solution, manufactured by Takamatsu Yushi Co., Ltd.) | 234 g |

-continued

| (1) Preparation of Coating Solution for Undercoat Layer Prescription (1) (undercoat layer on the photosensitive layer side) | |
|---|---|
| Polyethylene glycol monononylphenyl ether (average ethylene oxide number: 8.5, 10 wt % solution) | 21.5 g |
| MP-1000 (polymer fine particles, manufactured by Soken Kagaku Co. Ltd.) | 0.91 g |
| Distilled water | 744 ml |

| Prescription (2) (first layer on the back surface side) | |
|---|---|
| Butadiene/styrene copolymer latex (solid content: 40 wt %, weight ratio of butadiene/styrene: 32/68) | 131 g |
| Sodium 2,4-dichloro-6-hydroxy-s-triazine (8 wt % aqueous solution) | 5.1 g |
| Sodium laurylbenzenesulfonate (1 wt % aqueous solution) | 10 ml |
| Distilled water | 854 ml |

| Prescription (3) (second layer on the back surface side) | |
|---|---|
| $SnO_2$/SbO (9/1 by weight, average particle size: 0.038 μm, 17 wt % dispersion) | shown in Table 1 |
| Gelatin (10 wt % aqueous solution) | 65.7 g |
| Metrose TC-5 (2 wt % aqueous solution, manufactured by Shin-Etsu Chemical Co., Ltd.) | 6.3 g |
| MP-1000 (polymer fine particles, average particle size: 0.4 μm, manufactured by Soken Kagaku Co. Ltd.) | 0.01 g |
| Sodium dodecylbenzenesulfonate (1 wt % aqueous solution) | 10 ml |
| Proxel (manufactured by ICI Co., Ltd.) | 1 ml |
| Distilled water | 856 ml |

Preparation of Undercoated Support

Both surfaces of the above-prepared biaxially stretched polyethylene terephthalate support having a film thickness of 175 μm were subjected to corona discharge treatment, then the above undercoating solution prescription (1) was coated on one side (photosensitive layer side) by means of a wire bar in a wet coating amount of 6.6 ml/$m^2$ (per one surface) and dried at 180° C. for 5 minutes. Subsequently, the above undercoating solution prescription (2) was coated on the back surface by means of a wire bar in a wet coating amount of 5.7 ml/$m^2$ and dried at 180° C. for 5 minutes, and further the above undercoating solution prescription (3) was coated on the back surface by means of a wire bar in a wet coating amount of 5.7 ml/$m^2$ and dried at 180° C. for 6 minutes. Thus, the undercoated support was prepared.

Preparation of Back Surface Coating Solution

Preparation of Solid Fine Particle Dispersion Solution (a) of Base Precursor

A base precursor compound 11 shown below (64 g), 28 g of a diphenylsulfone compound 12 shown below, and 10 g of surfactant Demol N (manufactured by Kao Corporation) were mixed with 220 ml of distilled water. The mixed solution was dispersed using beads in a sand mill (¼ Gallon sand grinder mill, manufactured by Imex Co., Ltd.), thereby a solid fine particle dispersion solution (a) of the base precursor compound having an average particle size of 0.2 μm was obtained.

Preparation of Solid Fine Particle Dispersion Solution of Dye

Cyanine dye compound 13 shown below (9.6 g) and 5.8 g of sodium p-dodecylbenzenesulfonate were mixed with 305 ml of distilled water. The mixed solution was dispersed using beads in a sand mill (¼ Gallon sand grinder mill, manufactured by Imex Co., Ltd.), thereby a solid fine particle dispersion solution of the dye having an average particle size of 0.2 μm was obtained.

Preparation of Antihalation Layer Coating Solution

Gelatin (17 g), 9.6 g of polyacrylamide, 70 g of the above solid fine particle dispersion solution (a) of the base precursor, the above solid fire particle dispersion solution of the dye (the amount was adjusted so as to reach the optical density of the back surface side shown in Table 1), 1.5 g of polymethyl methacrylate fine particles (average particle size: 6.5 μm), 2.2 g of sodium polyethylenesulfonate, 0.2 g of a bluing dye compound 14 shown below, and 844 ml of $H_2O$ were mixed. Thus, an antihalation layer coating solution was prepared.

Preparation of Back Surface Protective Layer Coating Solution

To a reaction vessel maintained at 40° C. were added and mixed 50 g of gelatin, 0.2 g of sodium polystyrenesulfonate, 2.4 g of NN'-ethylenebis(vinyl sulfone acetamide), 1 g of sodium t-octylphenoxyethoxyethanesulfonate, 30 mg of compound 4 shown below, 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization weight ratio: 5/95), and 950 ml of $H_2O$ to prepare a back surface protective layer coating solution.

Preparation of Silver Halide Grains 1

To 1,421 ml of distilled water were added 8.0 ml of a 1 wt % potassium bromide solution, 8.2 ml of 1 N nitric acid and 20 g of phthalated gelatin. This mixed solution was stirred in a titanium-coated stainless reaction vessel with maintaining the temperature at 37° C. Solution A (37.04 g of silver nitrate was diluted with distilled water to make 159 ml) and solution B (32.6 g of potassium bromide was diluted with distilled water to make 200 ml) were prepared. The entire amount of solution A was added to the reaction vessel at a constant flow rate by a controlled double jet method with maintaining pAg at 8.1 over 1 minute. Solution B was added by a controlled double jet method. Then, 30 ml of a 3.5 wt % hydrogen peroxide aqueous solution was added, further, 36 ml of a 3 wt % aqueous solution of compound 1 shown below was added thereto. Solution A2 (solution A was again diluted with distilled water to make 317.5 ml) and solution B2 (compound 2 shown below was dissolved in solution B so as to make the final concentration $1\times10^{-4}$ mol per mol of the silver, diluted with distilled water to reach the volume of 2 times of solution B, i.e., 400 ml) were prepared. The entire amount of solution A2 was added to the reaction vessel at a constant flow rate by a controlled double jet method with maintaining pAg at 8.1 over 10 minutes. Solution B2 was added by a controlled double jet method. Then, 50 ml of a 0.5 wt % methanol solution of compound 3 shown below was added, further, pAg was raised to 7.5 with silver nitrate, pH was adjusted to 3.8 with 1 N sulfuric acid, and stirring was stopped. After the reaction solution was subjected to precipitation, desalting and washing processes, 3.5 g of deionized gelatin was added, and then 1 N sodium hydroxide was added to adjust pH to 6.0 and pAg to 8.2, thereby a silver halide dispersion was obtained.

The grains in the thus-prepared silver halide emulsion were pure silver bromide grains having an average equivalent-sphere diameter of 0.053 μm and equivalent-sphere diameter variation coefficient of 18%. Grain size was the average of 1,000 grains obtained by electron microscope. {100} face ratio of this grain was 85% according to the Kubelka-Munk method.

The temperature of the above emulsion was maintained at 38° C. with stirring, then 0.035 g of a 3.5 wt % methanol solution of compound 4 was added thereto, and 40 minute after, a solid dispersion of spectral sensitizing dye A shown below (an aqueous gelatin solution) was added in an amount of $5\times10^{-3}$ mol per mol of the silver, and 1 minute after, the temperature was raised to 47° C., 20 minutes thereafter compound 5 shown below was added thereto in an amount of $3\times10^{-5}$ mol per mol of the silver, and further 2 minutes after, $5\times10^{-5}$ mol per mol of the silver of a tellurium sensitizer B shown below was added and the reaction solution was subjected to ripening for 90 minutes. Immediately before completion of ripening, 5 ml of a 0.5 wt % methanol solution of compound 6 shown below was added. The temperature of the reaction solution was lowered to 31° C. Then, 5 ml of a 3.5 wt % methanol solution of compound 7 shown below was added thereto, and further compound 3 in an amount of $7\times10^{-3}$ mol per mol of the silver, and compound 8 shown below in an amount of $6.4\times10^{-3}$ mol per mol of the silver were respectively added, thus silver halide emulsion 1 was prepared.

Preparation of Silver Halide Grains 2

A pure silver bromide cubic grain emulsion having an average equivalent-sphere diameter of 0.08 μm and equivalent-sphere diameter variation coefficient of 15% was prepared in the same manner as in the preparation of silver halide emulsion 1 except that the temperature of the solution during grain formation of 37° C. was changed to 50° C. The emulsion was subjected to precipitation, desalting, washing and dispersion in the same manner as in the preparation of silver halide emulsion 1. Spectral sensitization, chemical sensitization, and the addition of compounds 3 and 8 were performed in the same manner as in the preparation of silver halide emulsion 1 except for changing the addition amount of spectral sensitizing dye A to $4.5\times10^{-3}$ mol per mol of the silver, thus silver halide emulsion 2 was obtained.

Preparation of Silver Halide Grains 3

A pure silver bromide cubic grain emulsion having an average equivalent-sphere diameter of 0.038 μm and equivalent-sphere diameter variation coefficient of 20% was prepared in the same manner as in the preparation of silver halide emulsion 1 except that the temperature of the solution during grain formation of 37° C. was changed to 27° C. The emulsion was subjected to precipitation, desalting, washing and dispersion in the same manner as in the preparation of silver halide emulsion 1. Spectral sensitization, chemical sensitization, and the addition of compounds 3 and 8 were performed in the same manner as in the preparation of silver halide emulsion 1 except for changing the addition amount of spectral sensitizing dye A to $6'10^{-3}$ mol per mol of the silver, thus silver halide emulsion 3 was obtained.

Preparation of Mixed Emulsion A for Coating Solution

Silver halide emulsion 1 in an amount of 70 wt %, silver halide emulsion 2 in an amount of 15 wt % and silver halide emulsion 3 in an amount of 15 wt % were dissolved, and a 1 wt % aqueous solution of compound 9 shown below was added thereto in an amount of $7\times10^{-3}$ mol per mol of the silver.

Preparation of Scaly Fatty Acid Silver Salt

Behenic acid (87.6 g) (manufactured by Henkel Co., trade name: Edenor C22-85R), 423 ml of distilled water, 49.2 ml of an aqueous solution containing 5N NaOH, and 120 ml of tert-butanol were mixed, and the mixture was allowed to react for 1 hour at 75° C., thereby a sodium behenate solution was obtained. Apart from the sodium behenate solution, 206.2 ml of an aqueous solution containing 40.4 g of silver nitrate (pH 4.0) was prepared and maintained at 10° C. A reaction vessel containing 635 ml of distilled water and 30 ml of tert-butanol was maintained at 30° C., with stirring the content in the reaction vessel, the entire amount of the above sodium behenate solution and the entire amount of the aqueous silver nitrate solution were added to the reaction vessel at a constant flow rate over 62 minutes and 10 seconds and 60 minutes, respectively, in such a manner that only the aqueous silver nitrate solution was added from the start of the addition, 7 minutes and 20 seconds after the start of the addition of the aqueous silver nitrate solution, the addition of the sodium behenate solution was started, and only the sodium behenate solution was added for 9 minutes and 30 seconds after the termination of the addition of the aqueous silver nitrate solution. The temperature in the reaction vessel was maintained at 30° C. and the outer temperature was controlled so as to maintain the solution temperature constant. The piping of the addition system of the sodium behenate solution was warmed by the steamed jacket method, and steam aperture was adjusted so that the solution temperature at the outlet of the addition nozzle tip became 75° C. The piping of the addition system of the aqueous silver nitrate solution was warmed by circulating chilled water in the outer pipe of the double pipe. The positions where the sodium behenate solution and the aqueous silver nitrate solution were added were arranged symmetrically with the stirring axle between, and the height of the position was adjusted so as not to touch the reaction solution.

After the addition of the sodium behenate solution was finished, the reaction solution was stirred at the same temperature for 20 minutes and allowed to stand to lower the temperature to 25° C. The solid content was then filtered by suction. The solid content was washed with water until the conductivity of the filtrate reached 30 μS/cm. Thus, a fatty acid silver salt was obtained. The solid content obtained was not dried and stored as a wet cake.

The shape of the obtained silver behenate particles was evaluated with an electron microscope. The obtained silver behenate particles were scaly crystals having a=0.14 μm, b=0.4 μm, and c=0.6 μm, on average, average equivalent-sphere diameter of 0.52 μm, and variation coefficient of the average equivalent-sphere diameter of 15%. (a, b and c were defined above.)

Polyvinyl alcohol (tradename: PVA-205) (7.4 g) and water were added to the wet cake of the amount corresponding to 100 g of dried solid content to make the entire amount 385 g, and then the above product was preliminarily dispersed in a homomixer.

The preliminarily dispersed starting solution was treated three times using a disperser (trade name: Micro-fluidizer M-110S-EH equipped with G10Z interaction chamber, manufactured by Micro Fluidex International Corp.). Pressure of the disperser was adjusted to 1,750 kg/cm$^2$. Thus, silver behenate dispersion was obtained. Cooling operation was performed by installing coiled heat exchangers respectively before and after the interaction chamber and setting the temperature of dispersion at 18° C. by adjusting the temperature of the cooling medium.

Preparation of 25 wt % Dispersion of Reducing Agent

Water (16 kg) was added to 10 kg of 1,1-bis(2-hydroxy-3,5-dimethylphenyl)-3,5,5-trimethylhexane and 10 kg of a 20 wt % aqueous solution of modified polyvinyl alcohol Poval MP203 (manufactured by Kuraray Co., Ltd.), and thoroughly mixed to make a slurry. The slurry was fed to a horizontal sand mill (UVM-2, manufactured by Imex Co., Ltd.) packed with zirconia beads having an average diameter of 0.5 mm by means of a diaphragm pump and dispersed for 3 hours 30 minutes. Sodium salt of benzoisothiazolinone (0.2 g) and water were added to the above dispersion to make the concentration of the reducing agent 25 wt %, thereby the dispersion of the reducing agent was obtained. The particles of the reducing agent contained in the thus-obtained reducing agent dispersion had a median particle diameter of 0.42 μm and a maximum particle diameter of 2.0 μm or less. The obtained reducing agent dispersion was filtered through a polypropylene filter having a pore diameter of 10.0 μm to remove impurities such as dusts and stored.

Preparation of 10 wt % Dispersion of Mercaoto Compound

Water (8.3 kg) was added to 5 kg of compound 8 and 5 kg of a 20 wt % aqueous solution of modified polyvinyl alcohol Poval MP203 (manufactured by Kuraray Co., Ltd.), and thoroughly mixed to make a slurry. The slurry was fed to a horizontal sand mill (UVM-2, manufactured by Imex Co., Ltd.) Packed with zirconia beads having an average diameter of 0.5 mm by means of a diaphragm pump and dispersed for 6 hours. Sodium salt of benzoisothiazolinone (0.2 g) and water were added to the above dispersion to make the concentration of the mercapto compound 10 wt %, thereby the dispersion of the mercapto compound was obtained. The particles of the mercapto compound contained in the thus-obtained mercapto compound dispersion had a median particle diameter of 0.40 μm and a maximum particle diameter of 2.0 μm or less. The obtained mercapto compound dispersion was filtered through a polypropylene filter having a pore diameter of 10.0 μm to remove impurities such as dusts and stored.

Preparation of 20 wt % Organic Polyhalogen Compound Dispersion-1

Water (10 kg) was added to 5 kg of tribromomethylnaphthylsulfone, 2.5 kg of a 20 wt % aqueous solution of modified polyvinyl alcohol Poval MP203 (manufactured by Kuraray Co., Ltd.), and 213 g of a 20 wt % aqueous solution of sodium triisopropylnaphthalenesulfonate, and thoroughly mixed to make a slurry. The slurry was fed to a horizontal sand mill (UVM-2, manufactured by Imex Co., Ltd.) packed with zirconia beads having an average diameter of 0.5 mm by means of a diaphragm pump and dispersed for 5 hours. Sodium salt of benzoisothiazolinone (0.2 g) and water were added to the above dispersion to make the concentration of the organic polyhalogen compound 20 wt %, thereby the dispersion of the organic polyhalogen compound was obtained. The particles of the organic polyhalogen compound contained in the thus-obtained organic polyhalogen compound dispersion had a median particle diameter of 0.36 μm and a maximum particle diameter of 2.0 μm or less. The obtained organic polyhalogen compound dispersion was filtered through a polypropylene filter having a pore diameter of 3.0 μm to remove impurities such as dusts and stored.

Preparation of 20 wt % Organic Polyhalogen Compound Dispersion-2

In-the preparation of 20 wt % organic polyhalogen compound dispersion-1, the procedure of dispersion and filtration was repeated in the same manner except for using 5 kg of tribromomethyl [4-(2,4,6-trimethylphenylsulfonyl) phenyl]-sulfone in place of 5 kg of tribromomethylnaphthylsulfone. The particles of the organic polyhalogen compound contained in the thus-obtained organic polyhalogen compound dispersion had a median particle diameter of 0.38 μm and a maximum particle diameter of 2.0 μm or less. The obtained organic polyhalogen compound dispersion was filtered through a polypropylene filter having a pore diameter of 3.0 μm to remove impurities such as dusts and stored.

Preparation of 20 wt % Organic Polyhalogen Compound Dispersion-3

In the preparation of 20 wt % organic polyhalogen compound dispersion-1, the procedure of dispersion and filtration was repeated in the same manner except for using 5 kg of tribromomethylphenylsulfone in place of 5 kg of tribromomethylnaphthylsulfone. The particles of the organic polyhalogen compound contained in the thus-obtained organic polyhalogen compound dispersion had a median particle diameter of 0.41 μm and a maximum particle diameter of 2.0 μm or less. The obtained organic polyhalogen compound dispersion was filtered through a polypropylene filter having a pore diameter of 3.0 μm to remove impurities such as dusts and stored.

Preparation of 10 wt % Methanol Solution of Phthalazine Compound

6-Isopropylphthalazine (10 g) was dissolved in 90 g of methanol and used.

Preparation of 20 wt % Dispersion of Pigment

Water (250 g) was added to 64 g of C.I. Pigment Blue 60 and 6.4 g of Demol N (manufactured by Kao Corporation), and thoroughly mixed to make a slurry. Zirconia beads (800 g) having an average diameter of 0.5 mm were added to a vessel with the above-obtained slurry and dispersed with a disperser (¼ G sand grinder mill, manufactured by Imex Co., Ltd.) for 25 hours, thereby the dispersion of the pigment was obtained. The particles of the pigment contained in the thus-obtained pigment dispersion had an average particle diameter of 0.21 μm.

Preparation of 40 wt % SBR Latex

SBR Latex purified by ultrafiltration was obtained as follows.

SBR latex shown below was diluted with distilled water to 10 times, and purified by means of module FS03-FC-FUY03A1 for ultrafiltration purification (Daisen Membrane System Co., Ltd.) until the ionic conductivity became 1.5 mS/cm. The concentration of the latex at this time was 40 wt %.

SBR Latex

Latex of —St (68)-Bu (29)-AA (3)—

Average particle size: 0.1 μm, concentration: 45 wt %, equilibrium moisture content at 25° C. 60% RH: 0.6 wt %, ionic conductivity: 4.2 mS/cm (ionic conductivity was measured using a conductometer CM-30S manufactured by Toa Denpa Kogyo Co., Ltd., and starting solution of the latex (40 wt %) was measured at 25° C.), pH: 8.2.

Preparation of Coating Solution for Emulsion Layer (photosensitive layer)

The above-obtained 20 wt % water dispersion of pigment (in the amount reaching the optical density shown in Table 1 below), 103 g of organic acid silver dispersion, 5 g of a 20 wt % aqueous solution of modified polyvinyl alcohol PVA-205 (manufactured by Kuraray Co., Ltd.), 25 g of the above-prepared 25 wt % reducing agent dispersion, total weight of 11.5 g of the above-prepared 20 wt % organic polyhalogen compound dispersion-1, dispersion-2 and dispersion-3 in the ratio of 5/1/3 (by weight), 6.2 g of the 10 wt % dispersion of mercapto compound, 106 g of the 40 wt % SBR latex purified by ultrafiltration, and 16 ml of the 10 wt % methanol solution of phthalazine compound were mixed, and 10 g of the above-prepared silver halide mixed emulsion A was thoroughly mixed with the above reaction mixture, thus an emulsion layer coating solution was obtained. The obtained emulsion layer coating solution was fed to a coating die as it was in a coating amount of 70 ml/M$^2$ and coated.

The above emulsion layer coating solution was revealed to have viscosity of 85 (mPa·s) at 40° C. (No. 1 rotor) measured by Model B viscometer (manufactured by Tokyo Keiki Co., Ltd.).

The viscosity of the coating solution measured by RFS Fluid Spectrometer (manufactured by Rheometrics Far East Co.) at 25° C. was 1,500, 220, 70, 40, 20 (mPa·s) at shear rate of 0.1, 1, 10, 100, 1,000 (1/sec), respectively.

Preparation of Interlayer Coating Solution of Emulsion Surface

To 772 g of a 10 wt % aqueous solution of polyvinyl alcohol PVA-205 (manufactured by Kuraray Co., Ltd.) and 226 g of a 27.5 wt % solution of latex of methyl methacrylate/ styrene/butyl acrylate/hydroxyethyl methacrylate/acrylic acid copolymer (copolymerization ratio by weight: 59/9/26/5/1) was added 2 ml of a5 wt % aqueous solution of Aerosol OT (manufactured by American Cyanamide Co.) to make an interlayer coating solution, which was fed to a coating die in a coating amount of 5 ml/m$^2$.

The viscosity of the coating solution was 21 (mPa·s) at 40° C. (No. 1 rotor) measured by Model B viscometer.

Preparation of First Emulsion Surface Protective Layer Coating Solution

Inert gelatin 64 g was dissolved in water,-and 16 g of a latex of methyl methacrylate/styrene/butyl acrylate/ hydroxyethyl methacrylate/acrylic acid copolymer (copolymerization ratio by weight: 59/9/25/5/2), 64 ml of a 10 wt % methanol solution of phthalic acid, 74 ml of a 10 wt % aqueous solution of 4-methylphthalic acid, 28 ml of 1N sulfuric acid, 5 ml of a 5 wt % aqueous solution of Aerosol OT (manufactured by American Cyanamide Co.), and 1 g of phenoxyethanol were added thereto. Water was added to make the total amount 1,000 g, and the obtained coating solution was fed to a coating die in a coating amount of 10 ml/m$^2$.

The viscosity of the coating solution was 17 (mPa·s) at 40° C. (No. 1 rotor) measured by Model B viscometer.

Preparation of Second Emulsion Surface Protective Layer Coating Solution

Inert gelatin 80 g was dissolved in water, and 20 g of a latex of methyl methacrylate/styrene/butyl acrylate/ hydroxyethyl acrylate/acrylic acid copolymer (copolymerization ratio by weight: 59/9/25/5/2), 20 ml of a 5 wt % aqueous solution of potassium salt of N-perfluorooctylsulfonyl-N-propylalanine, 50 ml of a 2 wt % aqueous solution of polyethylene glycol mono(N-perfluorooctylsulfonyl-N-propyl-2-aminoethyl) ether (average polymerization degree of ethylene oxide: 15), 16 ml of a 5 wt % aqueous solution of Aerosol OT (manufactured by American Cyanamide Co.), 4 g of polymethyl methacrylate fine particles (average particle size: 0.7 $\mu$m), 21 g of polymethyl methacrylate fine particles (average particle size: 6.4 $\mu$m), 1.6 g of 4-methylphthalic acid, 8. 1 g of phthalic acid, 44 ml of 1N sulfuric acid, and 10 mg of benzoisothiazolinone were added thereto. Water was added to make the total amount 1,555 g, and this mixed solution was mixed with 445 ml of an aqueous solution containing 4 wt % chrome alum and 0.67 wt % phthalic acid by means of a static mixer just before coating, thereby a surface protective layer coating solution was obtained. The obtained coating solution was fed to a coating die in a coating amount of 10 ml/m$^2$.

The viscosity of the coating solution was 9 (mPa·s) at 40° C. (No. 1 rotor) measured by Model B viscometer.

Preparation of Photothermographic Material

On the back side surface of the above-prepared undercoated support, antihalation layer coating solution and the back surface protective layer coating solution were simultaneously coated and dried in such a manner that the coating amount of the solid content of the solid fine particle dye of antihalation layer coating solution became 0.04 g/m$^2$ and the gelatin coating amount of the back surface protective layer coating solution became 1 g/m$^2$, thereby an antihalation backing layer was prepared.

The emulsion layer (the coating silver amount of the silver halide was 0.14 g/m$^2$), the interlayer, the first protective layer and the second protective layer were simultaneously multilayer-coated by slide bead coating on the opposite side of the backing layer side in this order from the undercoat side, thereby photothermographic material sample was prepared.

Coating speed was 160 m/min. The distance between the tip of the coating die and the support was 0. 18 mm. The coating widths of both left and right sides were adjusted to be broader than the width of the delivery slit of the coating solution by 0.5 mm. The pressure in the pressure reducing chamber was set lower than atmospheric pressure by 392 Pa. At that time, handling and temperature/humidity were controlled so that the support was not charged with electricity. In the subsequent chilling zone, air of dry-bulb temperature of 18° C. and wet-bulb temperature of 12° C. was blown for 30 seconds. After the coating solution was dried, dry air of dry-bulb temperature of 30° C. and wet-bulb temperature of 18° C. was blown at a helical floating type drying zone for 200 seconds. The sample was then passed through a drying zone at 70° C. for 30 seconds, and then cooled to 25° C., thereby the solvent in the coating solution was evaporated. In the chilling zone and drying zone, the average wind speed was 7 m/sec.

Compound 1

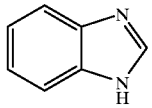

Compound 2

$K_3IrCl_6$

Compound 3

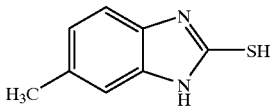

Compound 4

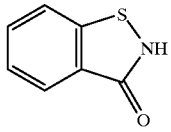

Compound 5

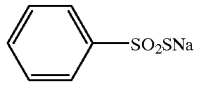

-continued

Compound 6

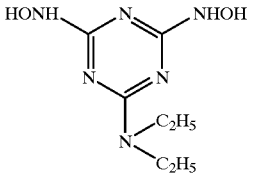

Compound 7

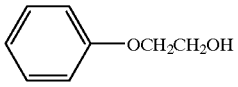

Compound 8

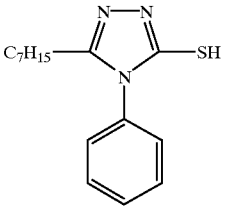

Compound 9

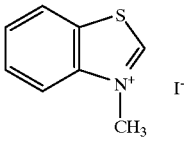

Spectral Sensitizing Dye A

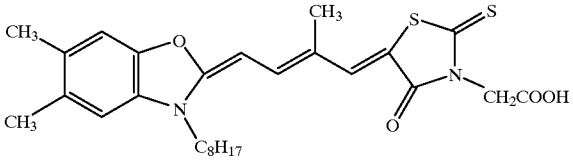

Tellurium Sensitizer B

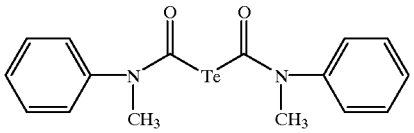

Base Precursor Compound 11

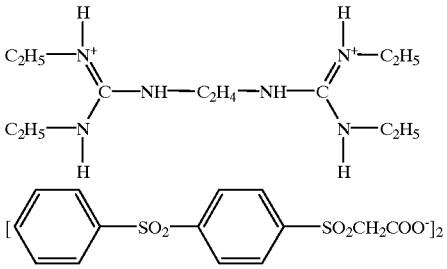

Compound 12

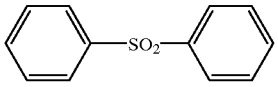

-continued

Cyanine Dye Compound 13

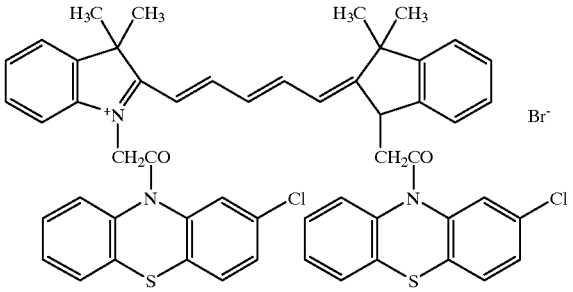

Bluing Dye Compound 14

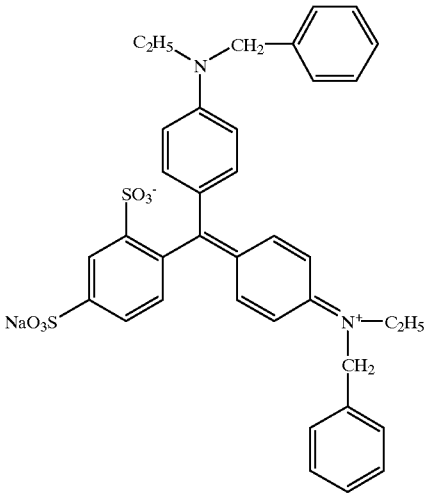

Samples after coating and drying were subjected to cutting/processing by processing speed of 35 m/min or 70 m/min. The total film thickness exclusive of the support was 21 $\mu$m.

Measurement of Surface Resistivity

After each sample was allowed to stand at 25° C., 25% RH for 12 hours, brass electrodes (stainless steel was used at the part in contact with the sample) having a length of 10 cm were set on the back surface of the sample at intervals of 0.14 cm. The electric resistance after 1 minute was measured with electrometer TR 8651 (manufactured by Takeda Riken Co., Ltd.). The surface resistivity was obtained from this measured value according to the following equation.

Surface resistivity (Ω)=electric resistance (Ω) measured×length of electrode (10 cm)÷distance between electrodes (0.14 cm)

Evaluation of Photographic Properties

Each sample was exposed with a laser sensitometer (details are shown below), the exposed sample was subjected to heat treatment (thermal development) at 118° C. for 5 seconds, then at 122° C. for 16 seconds, and the image obtained was evaluated by means of a densitometer.

Laser Sensitometer

Two 660 nm diode lasers having 35 mW output were gathered.

Single mode

Gaussian beam spot $1/e^2$ was 100 $\mu$m.

25 $\mu$m pitch to the side scanning direction, write of one pixel 4 times.

Evaluation of Clear Spot Failure

Each sample exposed with the exposure amount to give density 1.0 and then subjected to thermal development was visually evaluated.

○: Clear spot failure was not caused and excellent.

Δ: Clear spot failures were generated but practicable.

x: Clear spot failure was conspicuous and impracticable.

Evaluation of Density Unevenness by Processing

Clear spot was visually evaluated as unevenness of light and shade.

○: Unevenness of light and shade was not observed and excellent.

Δ: Unevenness of light and shade was observed a little but practicable.

x: Unevenness of light and shade was observed conspicuously and impracticable.

-continued

Dye Compound 15

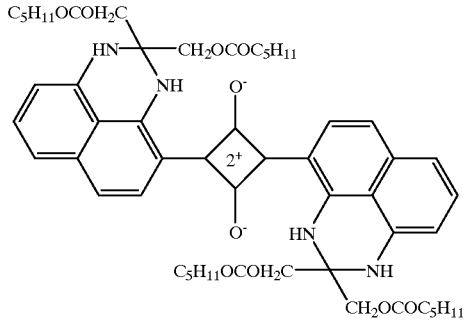

TABLE 1

| Sample No. | Surface Resistivity (Ω) | Coating Amount of $SnO_2/SbO$ ($mg/m^2$) | Optical Density at 660 nm (photosensitive layer side) | Clear Spot Failure | Density Unevenness by Processing |
|---|---|---|---|---|---|
| 1 (Comparison) | $5 \times 10^{14}$ | 0 | 0.03 | X | ○ |
| 2 (Comparison) | $5 \times 10^{14}$ | 0 | 0.1 | X | ○ |
| 3 (Comparison) | $5 \times 10^{14}$ | 0 | 0.25 | X | ○ |
| 4 (Comparison) | $5 \times 10^{14}$ | 0 | 0.4 | X | ○ |
| 5 (Comparison) | $5 \times 10^{14}$ | 0 | 0.7 | X | ○ |
| 6 (Comparison) | $2 \times 10^{10}$ | 100 | 0.03 | ○ | X |
| 7 (Comparison) | $2 \times 10^{10}$ | 100 | 0.1 | ○ | X |
| 8 (Invention) | $2 \times 10^{10}$ | 100 | 0.25 | ○ | ○ |
| 9 (Invention) | $2 \times 10^{10}$ | 100 | 0.4 | ○ | ○ |
| 10 (Invention) | $2 \times 10^{10}$ | 100 | 0.7 | ○ | ○ |
| 11 (Comparison) | $2 \times 10^{8}$ | 170 | 0.03 | ○ | X |
| 12 (Comparison) | $2 \times 10^{8}$ | 170 | 0.1 | ○ | X |
| 13 (Invention) | $2 \times 10^{8}$ | 170 | 0.25 | ○ | ○ |
| 14 (Invention) | $2 \times 10^{8}$ | 170 | 0.4 | ○ | ○ |
| 15 (Invention) | $2 \times 10^{8}$ | 170 | 0.7 | ○ | ○ |

The optical density of the back surface side at exposure time at 660 nm was 0.5.

It is clearly seen from the results in Table 1, that the present invention is excellent.

The results in Table 1 were the results by processing speed of 35 m/min, and the clear spot failures of Sample Nos. 1 to 4 by processing speed of 70 m/min were further deteriorated.

Example 2

The same experiment as in Example 1 was performed using samples prepared in the same manner except that spectral sensitizing dye B was used for laser exposure of 830 nm and dye compound 15 was used in the photosensitive layer side and the back surface side, respectively. The results obtained were the same as those in Example 1.

Spectral Sensitizing Dye B

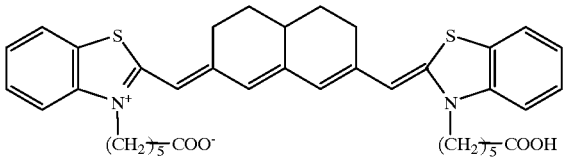

EFFECT OF THE INVENTION

Clear spot failure and the generation of density unevenness by processing can be prevented according to the present invention.

While the invention has been described in detail and with reference to specific examples thereof, it will be apparent to one skilled in the art that various changes and modifications can be made therein without departing from the spirit and scope thereof.

What is claimed is:

1. A photothermographic material comprising on one surface side of the support a layer comprising a photosensitive silver halide, a photo-insensitive organic silver salt, a reducing agent for a silver ion, and a binder, and an electroconductive layer, wherein said material has a surface resistivity (under the atmosphere of 25° C., 25% RH) of $10^{11}\Omega$ or less, and wherein the optical density at the exposure wavelength of the surface side containing the photosensitive silver halide is from 0.2 to 3.0.

2. The photothermographic material as claimed in claim 1, wherein the electroconductive layer contains a metallic oxide.

3. The photothermographic material as claimed in claim 1, wherein the electroconductive layer is provided on the surface of the support opposite to the side which contains the photosensitive silver halide.

4. The photothermographic material as claimed in claim 1, wherein the optical density at the exposure wavelength of the surface of the support opposite to the side which contains the photosensitive silver halide is from 0.2 to 3.0.

5. The photothermographic material as claimed in claim 1, wherein an antihalation layer which is decolored by the heat at thermal development is provided on the surface of the support opposite to the side which contains the photosensitive silver halide.

6. The photothermographic material as claimed in claim 1, wherein the total film thickness exclusive of the support is 15 to 38 $\mu$m.

* * * * *